US006363233B1

(12) United States Patent
Nakajima

(10) Patent No.: US 6,363,233 B1
(45) Date of Patent: Mar. 26, 2002

(54) COMPACT TONER CARTRIDGE WITH FRESH AND WASTE TONER CHAMBERS

(75) Inventor: Shigeki Nakajima, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 09/592,822

(22) Filed: Jun. 13, 2000

(51) Int. Cl.[7] ..... G03G 15/08

(52) U.S. Cl. ..... 399/120; 222/DIG. 1; 399/360

(58) Field of Search ..... 399/102, 119, 399/120, 358, 360, 262, 263, 256; 222/DIG. 1

(56) References Cited

U.S. PATENT DOCUMENTS 4,593,997 A * 6/1986 Fox et al. ..... 399/120
5,078,303 A * 1/1992 Kikuchi et al. ..... 222/167
5,568,237 A * 10/1996 Ishida et al. ..... 399/120
5,937,235 A * 8/1999 Huss et al. ..... 399/102

FOREIGN PATENT DOCUMENTS

JP 59-184373 * 10/1984

* cited by examiner

*Primary Examiner*—Arthur T. Grimley
*Assistant Examiner*—Hoang Neo
(74) *Attorney, Agent, or Firm*—Akin, Gump, Strauss, Hauer & Feld, L.L.P.

(57) ABSTRACT

A toner cartridge extending in a longitudinal direction thereof has a fresh toner chamber and a water toner chamber. The fresh toner chamber and waste toner chamber extend parallel to each other so that the fresh toner chamber and the waste toner chamber are aligned in a direction perpendicular to the longitudinal direction. The waste toner chamber incorporates a toner-conveying member such as a screw conveyor. The screw conveyor extends between the opposed longitudinal ends, and causes the waste toner to move further into the waste toner chamber. The waste toner chamber has an entrance formed therein through which waste toner is received from a print process cartridge. The entrance opens yieldably when a waste toner exit enters the waste toner chamber through the entrance and closes when the waste toner exit moves out of the enters the waste toner chamber.

31 Claims, 27 Drawing Sheets

COMPACT TONER CARTRIDGE WITH FRESH AND WASTE TONER CHAMBERS

BACKGROUND OF THE INVENTION

1. Field of the Invention

The present invention relates to a toner cartridge for use in an electrophotographic image recording apparatus.

2. Description of the Related Art

A conventional print process cartridge for an electrophotographic printer uses a toner cartridge that is designed to detachably mounted. Toner is discharged from the toner cartridge into a toner reservoir. The toner is agitated by an agitator and supplied to a developing unit.

Then, a developing roller applies the toner to a photoconductive drum which has an electrostatic latent image formed thereon, thereby developing the electrostatic latent image with the toner into a toner image. The toner image is then transferred by a transfer roller to a print medium. The toner image on the print medium is then fixed and the print paper is finally discharged from the printer.

A small amount of toner fails to be transferred from the photoconductive drum to the print paper and remains on the photoconductive drum. A variety of cleaning methods are available to collect the residual toner on the photoconductive drum during the cleaning process. A desirable cleaning method is such that a cleaning unit requires a smaller space for storing the waste toner. One such method is to return the residual toner as waste toner to the toner cartridge, so that the toner cartridge can be discarded with the waste toner collected therein.

This type of toner cartridge has a chamber for waste toner adjacent to a chamber for fresh toner, these two chambers being aligned in the longitudinal direction of the toner cartridge. Thus, the total length of the toner cartridge is the sum of the lengths of the fresh toner chamber and the waste toner chamber.

An opening formed in the toner cartridge is fitted to a waste toner exit of the print process cartridge, thereby coupling the toner cartridge to the print process cartridge. The waste toner is finally collected into the waste toner chamber of the toner cartridge through the waste toner exit.

The toner cartridge has a shutter mechanism formed near the opening. When the toner cartridge is disconnected from the waste toner exit of the print process cartridge, the shutter closes the opening to prevent the waste toner from falling through the opening from the toner cartridge.

As described above, the toner cartridge is relatively long due to the fact that the fresh toner chamber and the waste toner chamber are aligned in the longitudinal direction of the toner cartridge. The printer needs to be wide to accommodate a longitudinally long toner cartridge. If the waste toner chamber is made shorter in an attempt to reduce the width of the printer, the fresh toner chamber also has to be made shorter. If the fresh toner chamber has a length shorter than the width of a print region, the fresh toner may not be evenly supplied across the width of the print region, resulting in poor print quality.

Providing a shutter that closes the opening to prevent inadvertent spillage of toner from the toner cartridge requires a large number of mechanical parts which results in a complex mechanism. Such a complex mechanism causes frequent troubles and misuses.

SUMMARY OF THE INVENTION

The present invention was made in view of the aforementioned drawbacks.

An object of the invention is to provide a toner cartridge having a shorter longitudinal dimension than conventional toner cartridges, thereby implementing a miniaturized toner cartridge.

A toner cartridge extending in a longitudinal direction thereof, comprising a fresh toner chamber and a waster toner chamber. The fresh toner chamber extends in the longitudinal direction of the toner cartridge. The waste toner chamber extends parallel to the fresh toner chamber so that the fresh toner chamber and the waste toner chamber are aligned in a direction perpendicular to the longitudinal direction.

The fresh toner chamber has an opening through which the toner is discharged from said fresh toner chamber, a shutter, an operating lever, and a locking mechanism. The shutter closes the opening when the operating lever is at a first position at which the operating lever is locked by the locking mechanism and opens the opening when the operating lever is at a second position opposite to the first position.

The waste toner chamber has an entrance formed at one of opposed longitudinal ends of the waste toner chamber. The waste toner chamber receives waste toner through the entrance from outside. There is provided a toner-conveying member such as a screw conveyor in the waste toner chamber. The screw-conveying member extends between the opposed longitudinal ends, becoming higher with increasing distance from the first one of the opposed longitudinal ends and causing the waste toner to move further into the waste toner chamber. The toner-conveying member may extend in a horizontal direction and have a spiral blade on a part of the length thereof.

The waste toner chamber has a resilient member fitted into the entrance. The resilient member having a slit formed therein through which the waste toner exit enters the waste toner chamber when the toner cartridge is attached to the print process cartridge.

The resilient member is folded at said slit when the resilient member is fitted into the entrance.

The waste toner chamber has a flexible sleeve-like sealing member fitted to the entrance. The sealing member has one end opening to communicate with the opening of the waste toner chamber and another end normally resiliently closed. The closed end resiliently opens when the waste toner exit enters into the waste toner chamber through the sleeve-like sealing member, and resiliently closes when the waste toner exit comes out of the waste toner chamber.

The resilient member may be urged by a spring against the entrance. When the waste toner exit enters the waste toner chamber through the entrance, waste toner exit pushes the resilient member to yieldably move away from the entrance, thereby opening the entrance. When the waste toner exit moves out of the waste toner chamber through the entrance, the sprint urges the resilient member against the entrance, thereby closing the entrance.

The toner cartridge and the print process cartridge may have polarizers that matingly match each other, so that only a right toner cartridge can be attached into a corresponding location of the print process cartridge. This feature prevents misplacement of the toner cartridge in the print process cartridge.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

The present invention will be described in detail by way of example.

Overall Construction

Figure 1A:
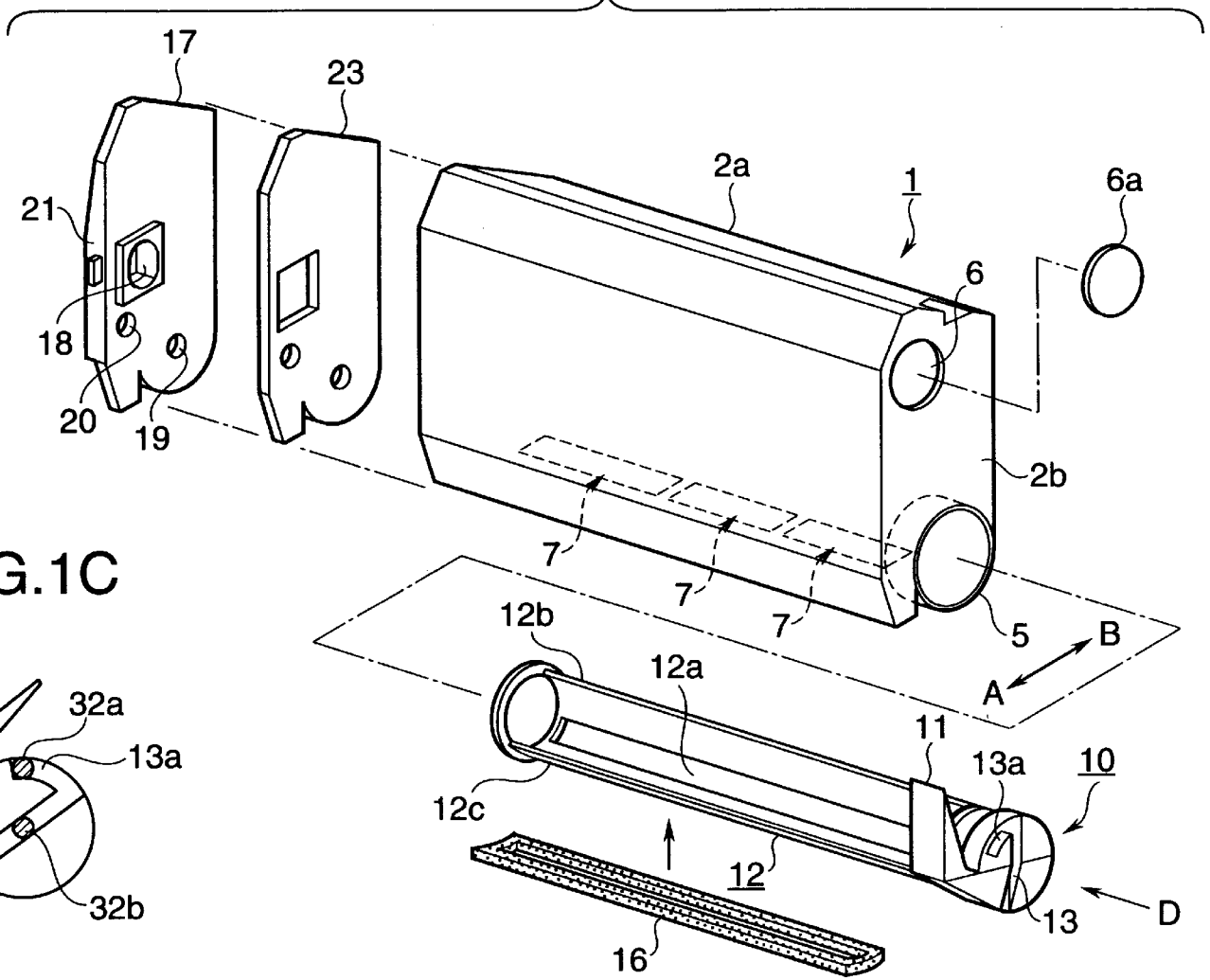
FIG. 1A is exploded perspective views of the toner cartridge according to the present invention.

FIG. 1A is an exploded perspective view of the toner cartridge.

Figure 1C:
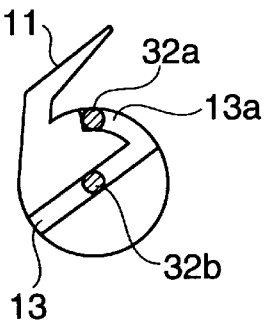
FIGS. 1B and 1C are side views of an operating knob as seen in a direction shown by arrow D.
Figure 1B:
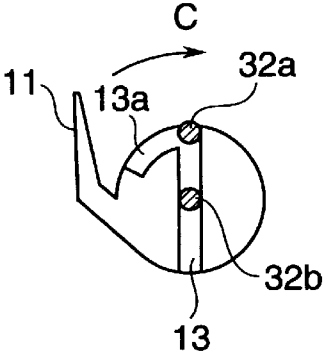

FIGS. 1B and IC are side view of an operating knob as seen in a direction shown by arrow D.

Referring to FIG. 1A, the toner cartridge 1 includes a main wall 2*a,* a side wall 2*b,* and a side plate. The side wall 2*b* and side plate 17 are provided to close opposed longitudinal ends of the main wall 2*a.* The main wall 2*a* is formed with a plurality of openings 7 in a bottom of the fresh toner chamber, the openings 7 being aligned in the longitudinal direction of the toner cartridge 1. The toner in the fresh chamber falls through the openings 17 into a later described print process cartridge 29, which includes a charging roller, a developing roller, a photoconductive drum and so on. The side wall 2*b* has a toner filling opening 6 formed therein through which the toner cartridge is filled with the fresh toner at the time of manufacture. A cap 6*a* is fitted to the toner filling opening 6 to close the toner filling opening after filling the fresh toner. The side wall 2*b* also has a hollow cylinder 5 into which a later described operating knob 10 fits. The main wall 2*a* is formed with coupling holes 9 at the longitudinal end opposite to the side wall 2*b.*

The toner cartridge 1 has the side wall 2*b* at one of opposite longitudinal ends and a side plate 17 at the other. A sealing sponge 23 is of the substantially the same shape as the side plate 17 and fits into the main wall 2*a* in intimate contact with inner surface of the main wall 2*a.* The side plate 17 is of substantially the same shape as the contour of the main wall 2*a.* The side plate 17 is formed with an opening 18 and holes 19 and 20 therein through which later described bosses 26 extends into the fresh toner chamber 3 and waste toner chamber 4, respectively. The toner cartridge 1 receives the waste toner through the opening 18 from the print process cartridge 29. The side plate 17 is formed with projections 21 on the side surface thereof (FIG. 2A) that fit into holes 9 in the main wall 2*a* when the side plate 17 is assembled to the main wall 2*a.* The side plate 17 is also formed with a recess 22 (FIG. 2A) into which a projection, not shown, of the print process cartridge 29 fits to prevent the toner cartridge 1 from rotating relative to the print process cartridge 29 or coming off print process cartridge 29.

Referring back to FIG. 1A, the operating knob 10 fits to the outer wall 2*b.* The operating knob 10 has a lever 11 and a shutter 12 formed in one-piece construction. The shutter 12 has two circumferential walls 12*b* and 12*c* and a longitudinally extending opening 12*a* formed between the circumferential walls 12*b* and 12*c*. When the operating knob 10 has been assembled into the toner cartridge 1, the shutter 12 closes the opening 7. The operating knob 10 is formed with a straight guide groove 13 that extends diametrically in the outer end surface of the operating knob 10. The operating knob 10 is also formed with an arcuate path 13*a* thereon that describes an arc about the center of the guide groove 13. When the toner cartridge 1 is assembled into the print process cartridge 29, later described projection 32*b* of the print process cartridge 29 enters the groove 13.

Figure 2A:
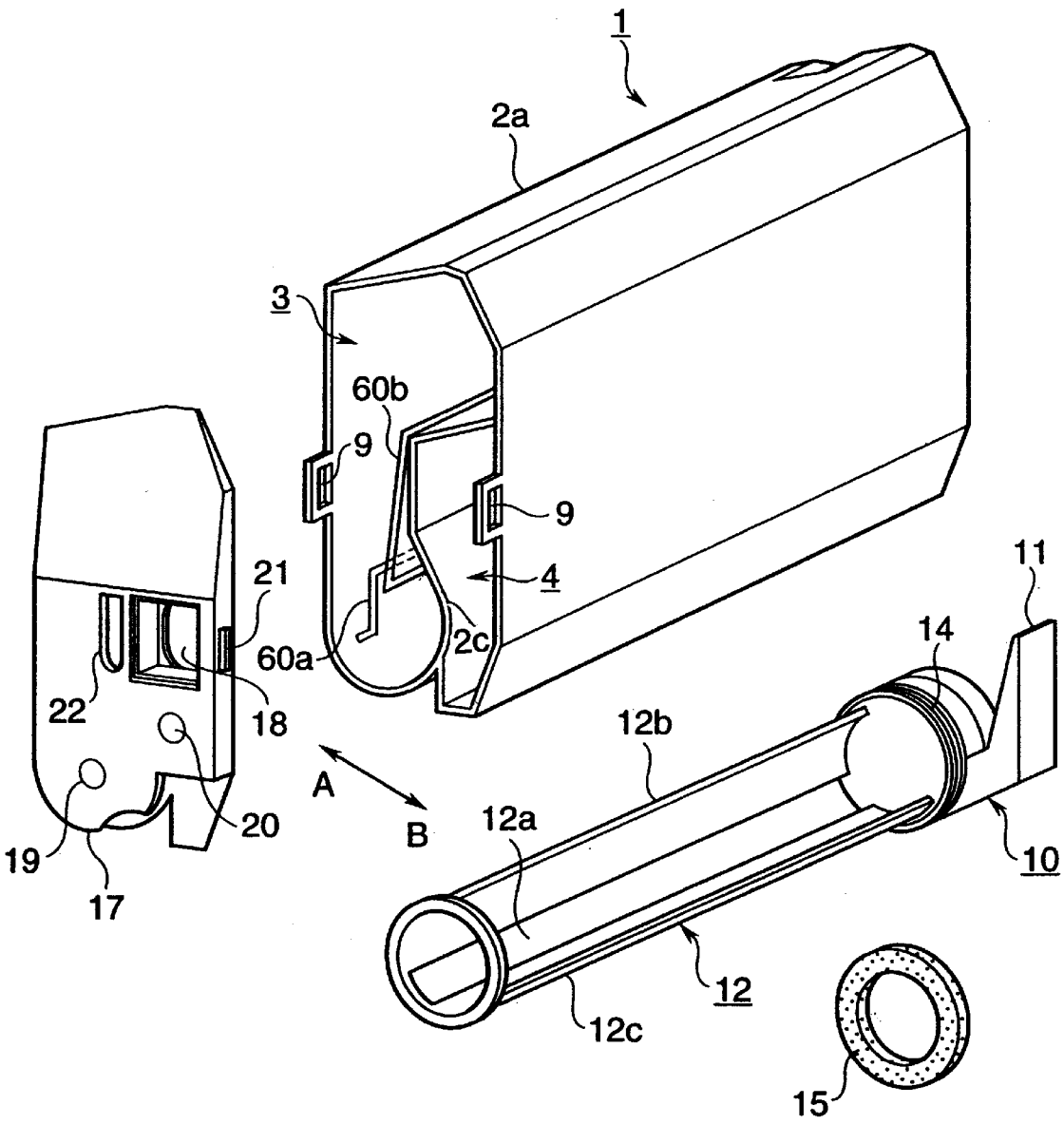
FIGS. 2A and 2B are exploded perspective views of the toner cartridge.
Figure 2B:
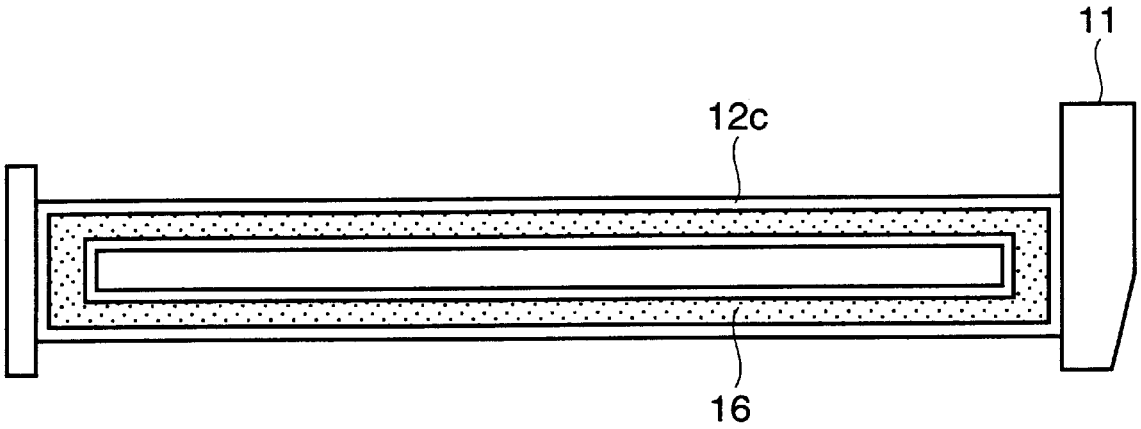

FIGS. 2A and 2B are exploded perspective views of the toner cartridge.

Referring to FIG. 2A, an inner wall 2*c* partitions the inner space of the toner cartridge 1 into a fresh toner chamber 3 which stores fresh toner therein and a waste toner chamber 4 which stores the waste toner that is delivered from a cleaning unit, not shown. The two chambers extend parallel to each other in the longitudinal direction of the toner cartridge 1, i.e., the two chambers are aligned in a direction (shown by arrow A–B) perpendicular to the longitudinal direction of the toner cartridge 1.

Referring to FIG. 2A, the operating knob 10 has an annular groove 14 formed on the other side of the groove 13 with respect to the lever 11. The groove 14 receives a doughnut-shaped sealing sponge 15 fitted therein. The sealing sponge 15 prevents the fresh toner from leaking through a gap between the operating knob 10 and an inner surface of the boss 5.

Referring to FIG. 2B, the circumferential wall 12*c* is formed with a shallow recess configured to a sealing sponge 16. The sealing sponge 16 is received in the shallow recess. The sealing sponge 16 slightly projects outwardly from the shallow recess to sealingly close the opening 7 when the shutter 12 is aligned with the openings 7, thereby preventing the fresh toner from leaking through the openings 7.

Figure 3A:
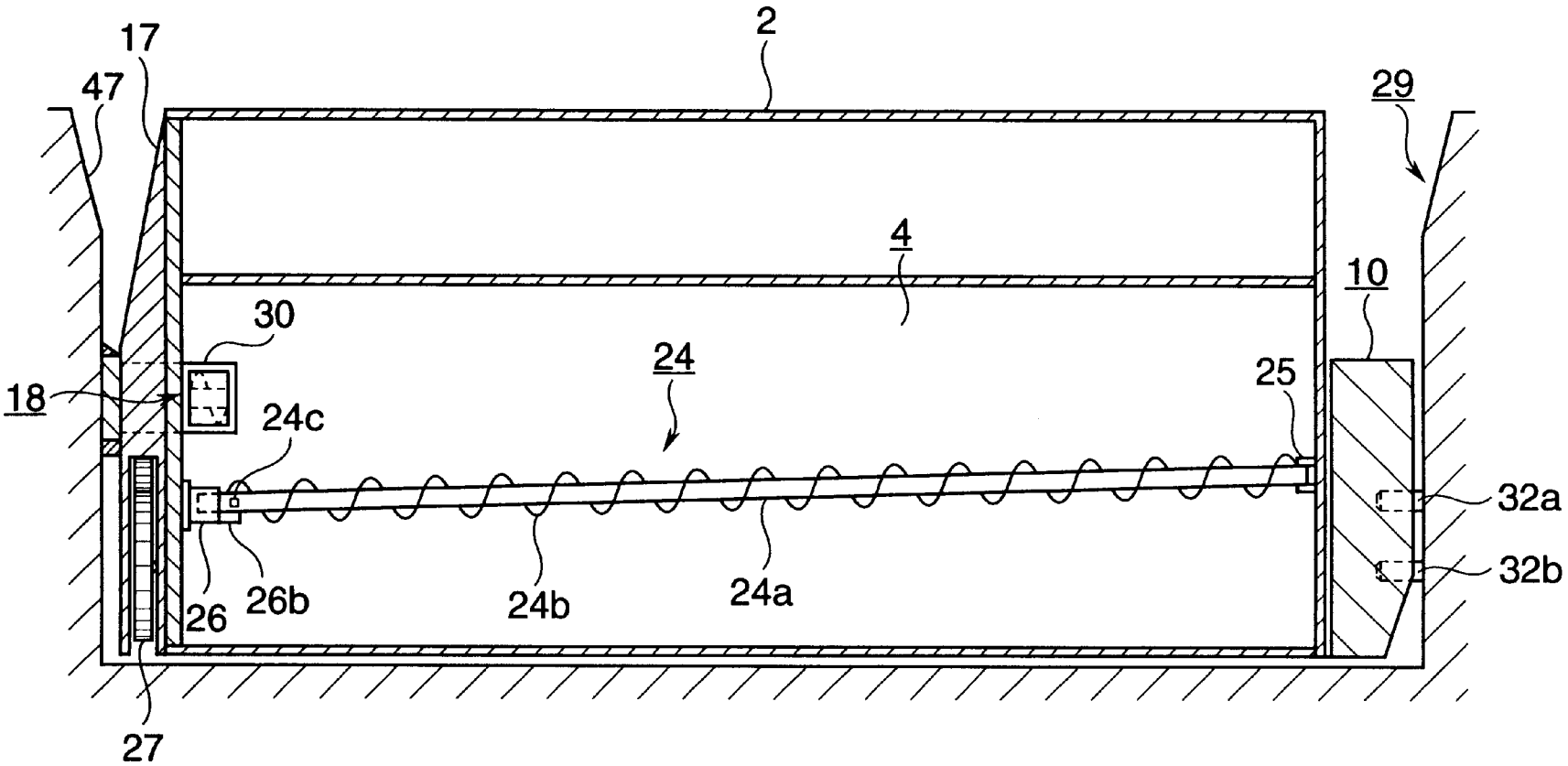
FIG. 3A is a cross-sectional view of a toner cartridge.

FIG. 3A is a cross-sectional view of a toner cartridge according to the invention.

Figure 3B:
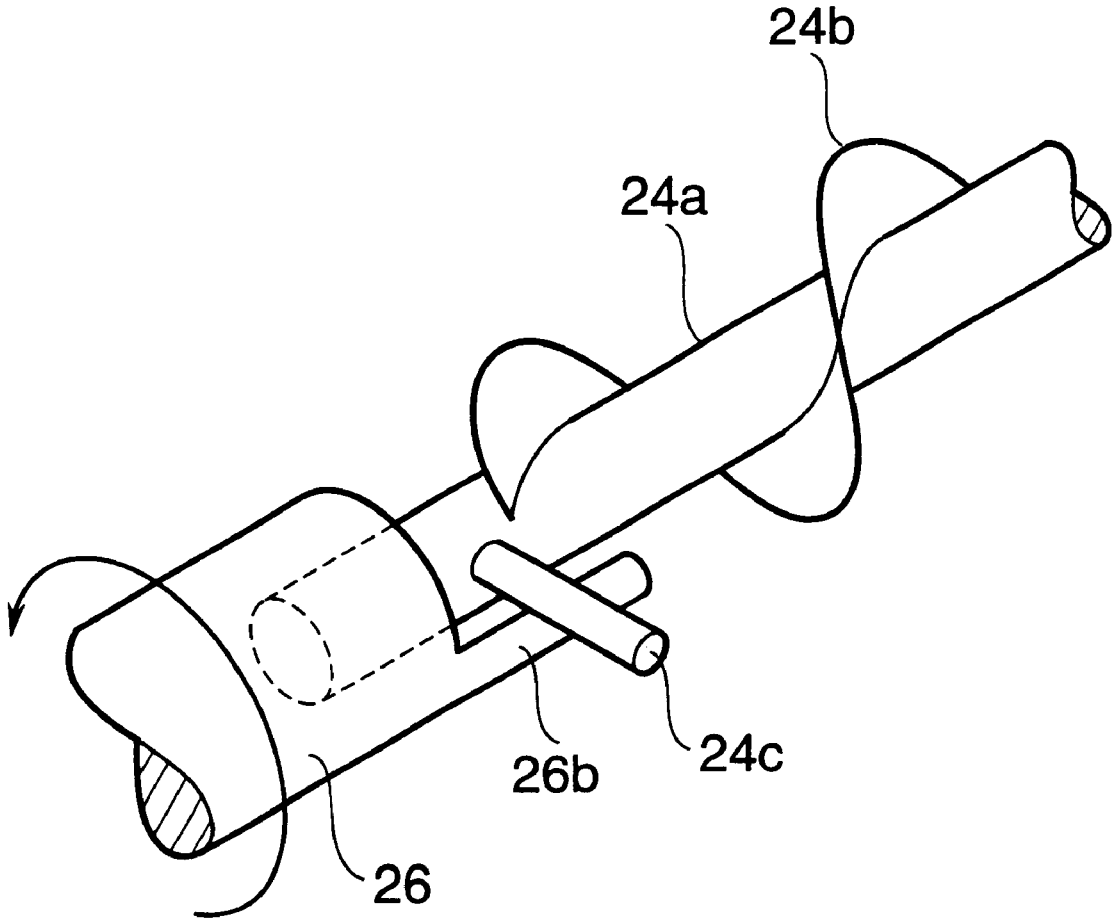
FIG. 3B is a fragmentary perspective view of a screw conveyor.

FIG. 3B is a fragmentary perspective view of a screw conveyor.

Referring to FIG. 3A, there is provided a screw conveyor 24 in the waste toner chamber 4. The screw conveyor 24 has a spiral blade 24*b* formed around a shaft 24*a* and spans the entire length of the toner cartridge 1. The screw conveyor 24 is made of, for example, plastics. The screw conveyor 24 is supported at one end thereof in a recess formed in a boss 26, and at the other end in a support 25 formed on the inner wall of the toner cartridge cover 2. The boss 26 is rotatably received in the holes 19 (20) of the side plate 17.

The boss 26 is mounted below the opening 18 of the side plate 17 while the support 25 is above the opening 18 so that the screw conveyor 24 is at an angle (e.g. 5 degrees) with the longitudinal direction of the toner cartridge 1.

Figure 4:
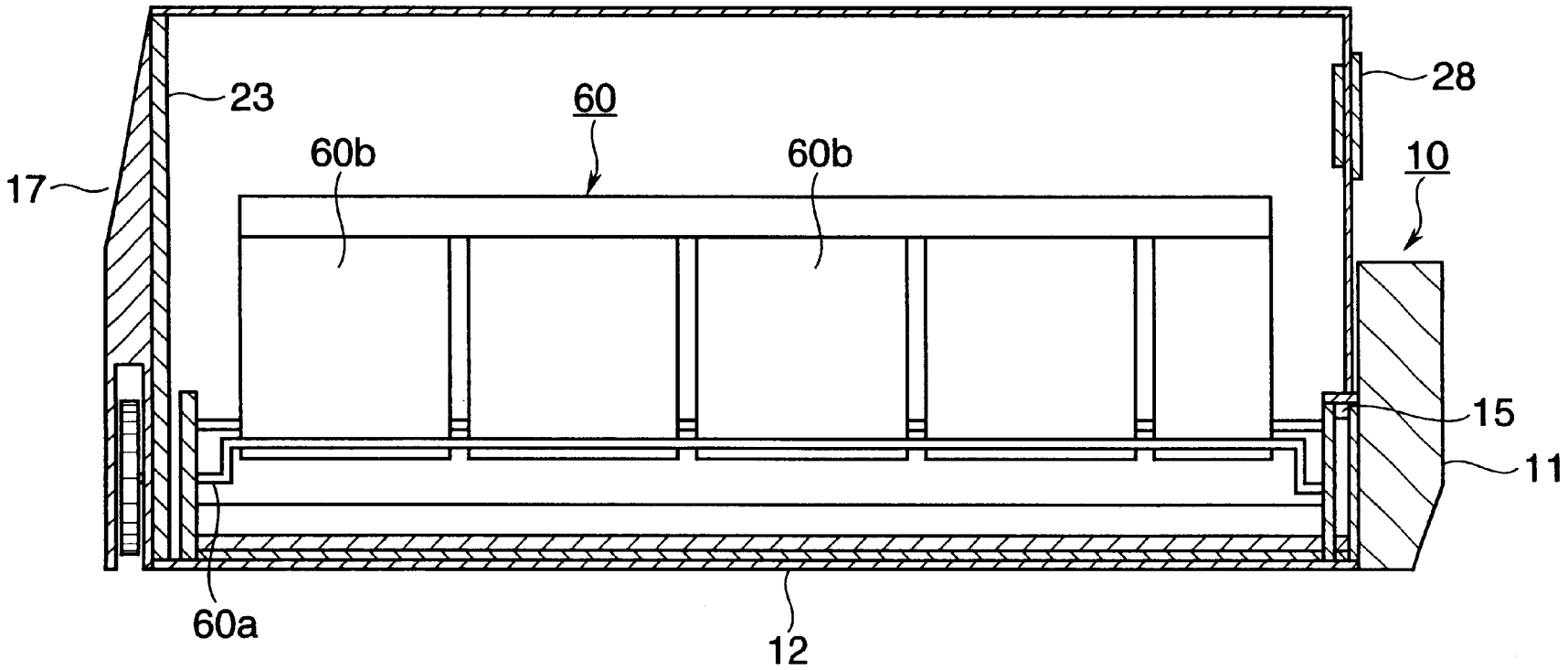
FIG. 4 is a cross-sectional view.

FIG. 4 is a cross-sectional view of the toner cartridge.

The fresh toner chamber 3 has a toner agitating mechanism 60 that includes a crank shaft 60*a* and flexible flaps 60*b* in the shape of a film that extends downward. The flexible flaps 60*b* are suspended from the top portion of the inner wall 2*c*. When the crank shaft 60*a* rotates, the crank shaft 60*a* taps the flexible flap 60, thereby agitating the toner in the fresh toner chamber. The crank shaft also agitates the fresh toner at the bottom of the fresh toner chamber.

The boss 26 is coupled to a gear 27 through, for example, a resilient claw so that the boss 26 is driven in rotation by the gear 27 when the gear train 27 rotates. The gear 27 is in mesh with a drive gear train, not shown, of the print process cartridge 29, and is driven in rotation. The boss 26 has a projection 26*b* and the screw conveyor 24 has a projection 24*c* at one end thereof close to the projection 26*b*. When the boss 26 rotates in a direction shown by arrow, the projection 26*b* abuts the projection 24*c* of the screw conveyor 24 to drive the screw conveyor 24 in rotation in the same direction, so that the screw conveyor 24 delivers the waste toner into the waste toner chamber.

Figure 5:
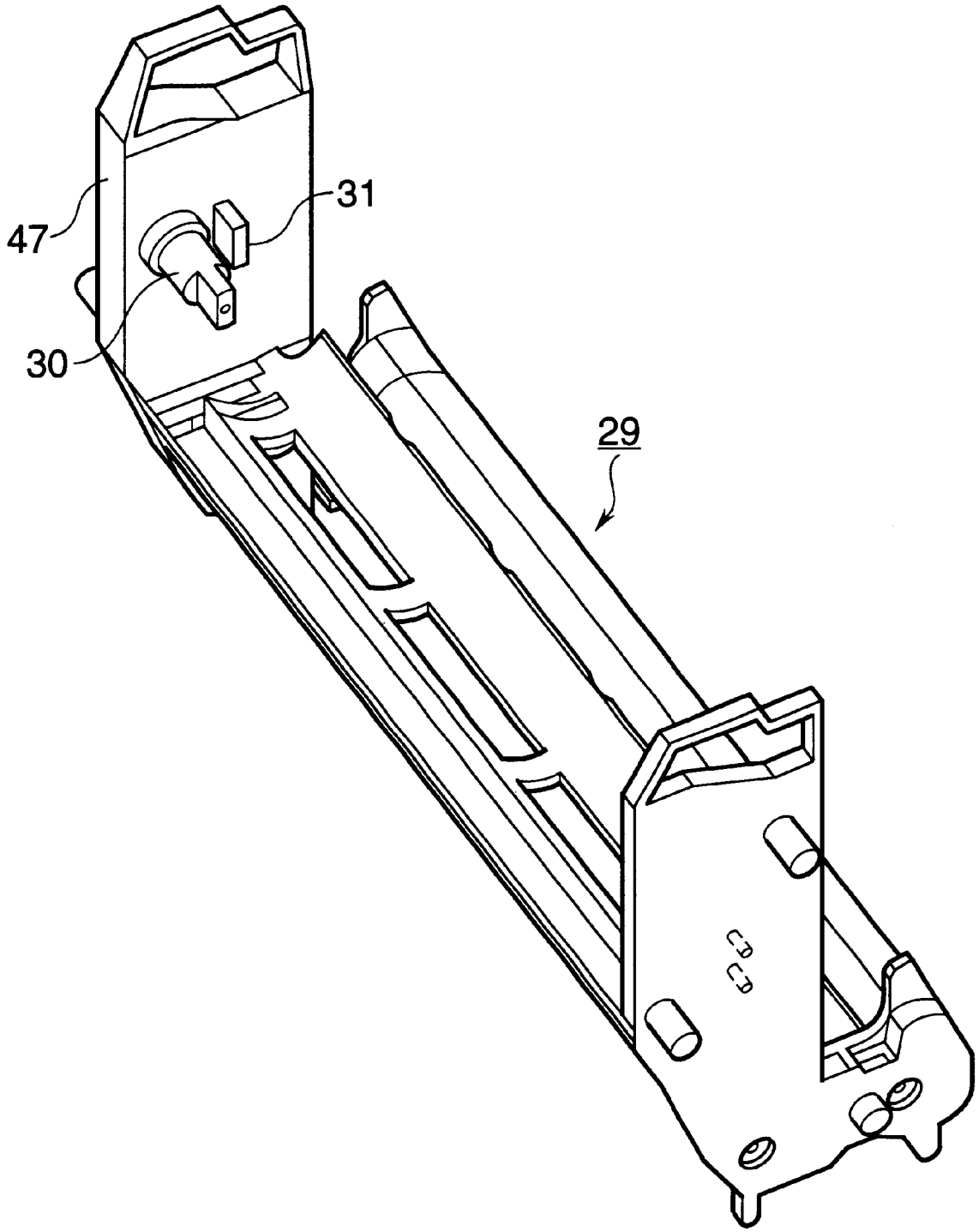
FIG. 5 is a perspective view of a print process cartridge.

FIG. 5 is a perspective view of a print process cartridge 29.

Referring to FIGS. 3 and 5, a side frame 47 of the print process cartridge 29 is formed with a projection 31 and a waste toner exit 30 through which the waste toner is discharged into the waste toner chamber of the toner cartridge 1. When the toner cartridge 1 is mounted to the print process cartridge 29, the waste toner exit 30 is fitted to the opening 18 of the toner cartridge 1 and the projection 31 fits into the recess 22 shown in FIG. 2A.

The mounting operation of the toner cartridge 1 will be described. As shown in FIG. 3, the print process cartridge 29 has the projections 32*a* and 32*b*. When the toner cartridge 1 is attached into the print process cartridge 29, the projection 32*b* enters the guide groove 13 formed in the operating knob 10 shown in FIG. 1B.

Figure 6:
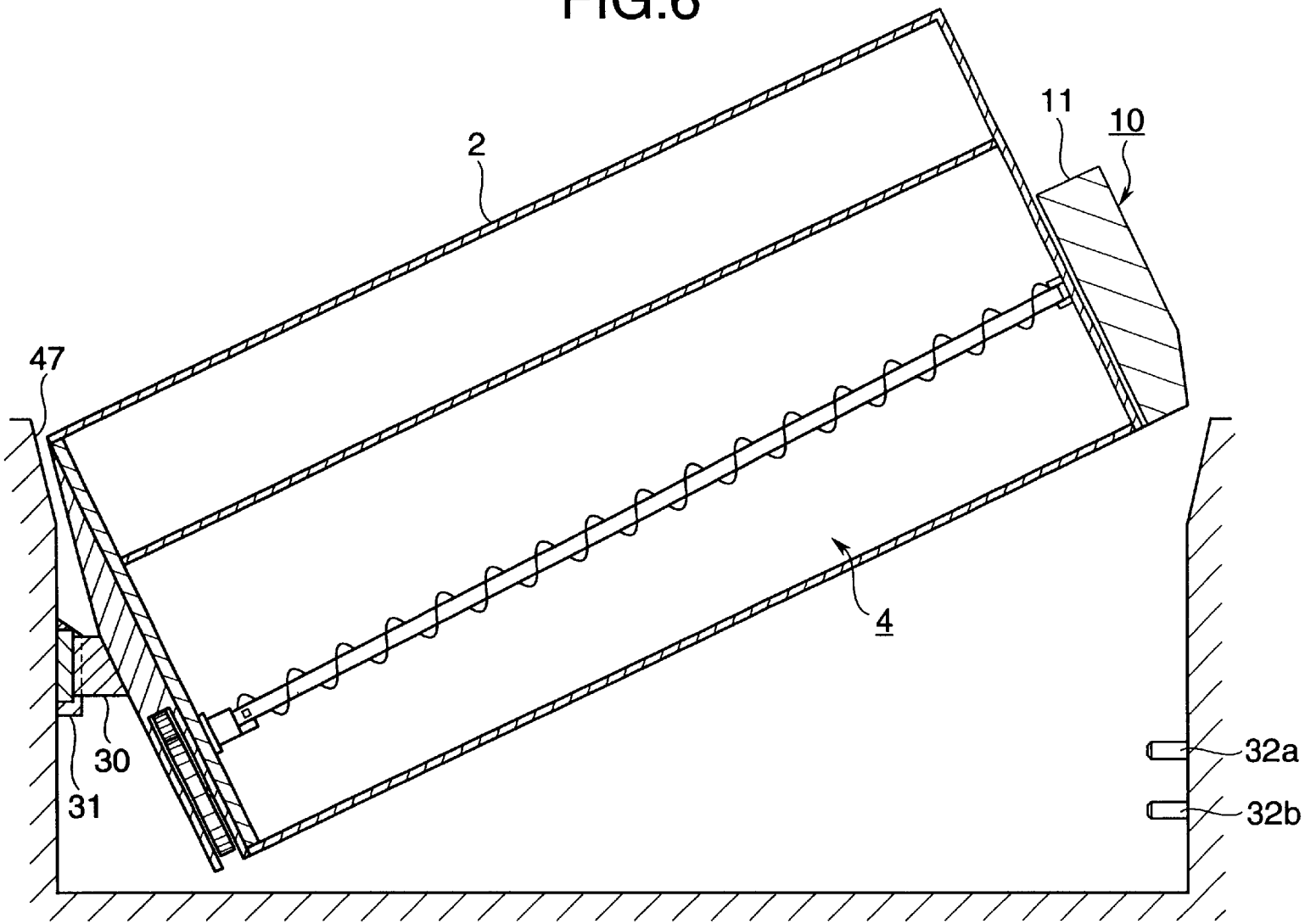
FIGS. 6 and 7 are cross-sectional views of the toner cartridge.
Figure 7:
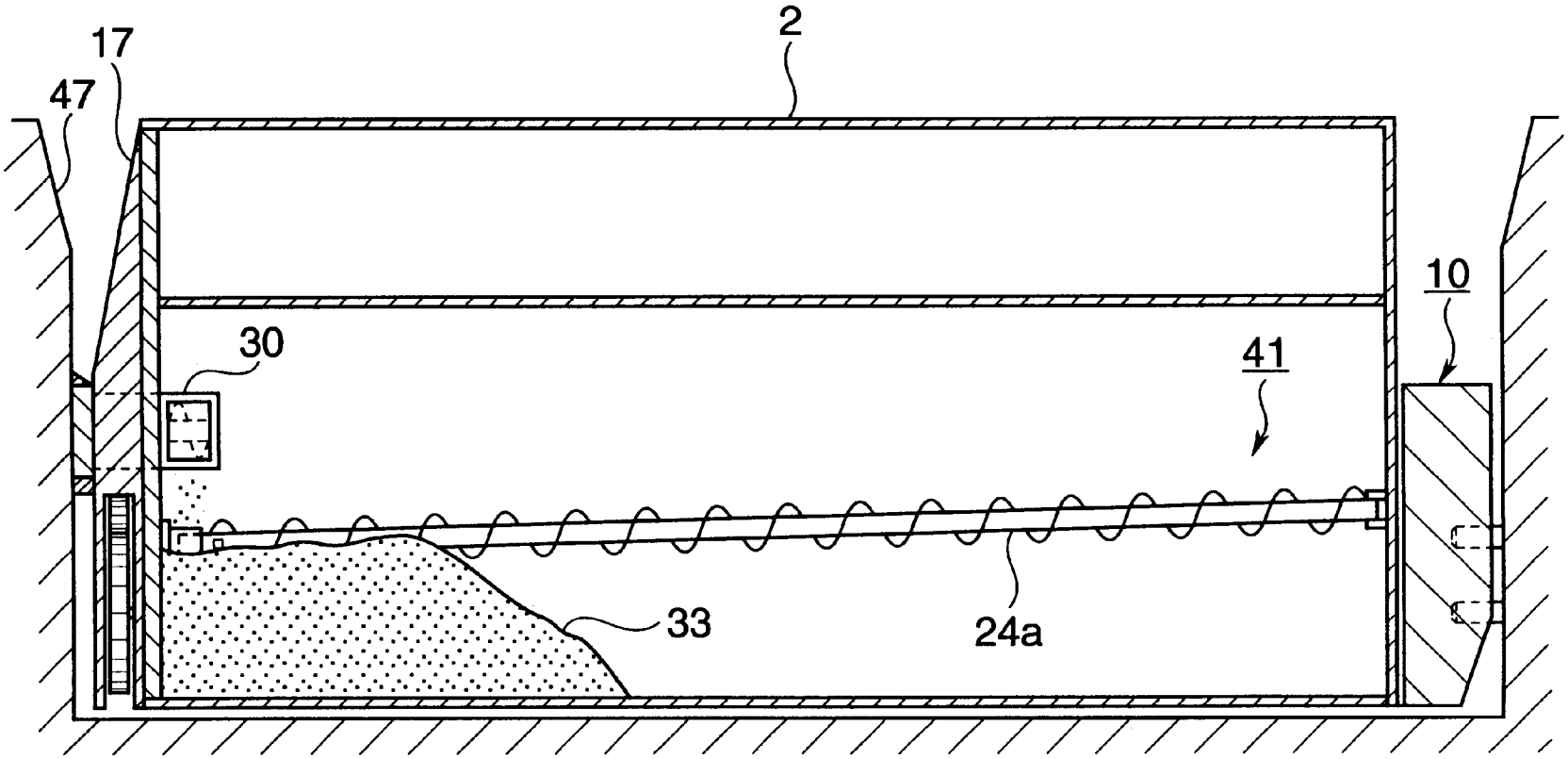

FIGS. 6 and 7 are cross-sectional views of the fresh toner chamber of the toner cartridge.

As shown in FIG. 6, the user holds the toner cartridge 1 obliquely, and lowers the toner cartridge 1 until the waste toner exit 30 of the print process cartridge 29 is received in the opening 18 formed in the side plate 17. When the tip of the waste toner exit 30 enters the opening 18, the user lowers the knob side of the toner cartridge 1 so that the toner cartridge 1 extends horizontal. The projection 31 of the print process cartridge 29 fits into the recess 22 of the side plate 17, thereby securely placing the toner cartridge 1 in position as well as preventing rotation or pullout of the toner cartridge 1. As the knob side of the toner cartridge 1 is lowered, the projection 32*b* on the print process cartridge 29 enters the guide groove 13 formed in the operating knob 10 as shown in FIG. 1B. The projection 32*b* is positioned substantially at the center of end surface of the operating knob 10. When the knob lever 11 is rotated about the projection 32*b* in a direction shown by arrow C as shown in FIG. 1B, the projection 32*a* moves along the arcuate path 13*a* on the operating knob 10 to a position of FIG. 1C where the toner shutter 12 opens the openings 7.

When the operating lever 11 is rotated, the shutter 12 integrally continuous with the operating knob 10 also rotates so that the fresh toner in the fresh toner chamber 3 is cascaded through the openings 7 into the print process cartridge 29.

The operation of the toner cartridge 1 of the above-mentioned construction for collecting the waste toner will be described.

The screw conveyor 24 continues to rotate during the toner collecting operation.

Referring to FIG. 7, the collected waste toner 33 falls from the waste toner exit 30 of the print process cartridge 29 into the waste toner chamber 4 through the opening 18 formed in the side plate 17. When the waste toner 33 piles up as high as the screw conveyor 24, the screw conveyor 24 conveys the waste toner 33 further into the waste toner chamber 4 or away from the opening 18. The aforementioned operation is repeated so that the waste toner 33 piles in the waste toner chamber 4. The screw conveyor 24 extends upwardly from the opening 18 and therefore the waste toner 33 also moves upwardly. The use of the screw conveyor 24 allows effective utilization of the upper space of the waste toner chamber 4. This is advantageous to miniaturizing the toner cartridge.

{Preventing Misplacement of Toner Cartridge and Modification of Screw Conveyor}

Figure 8:
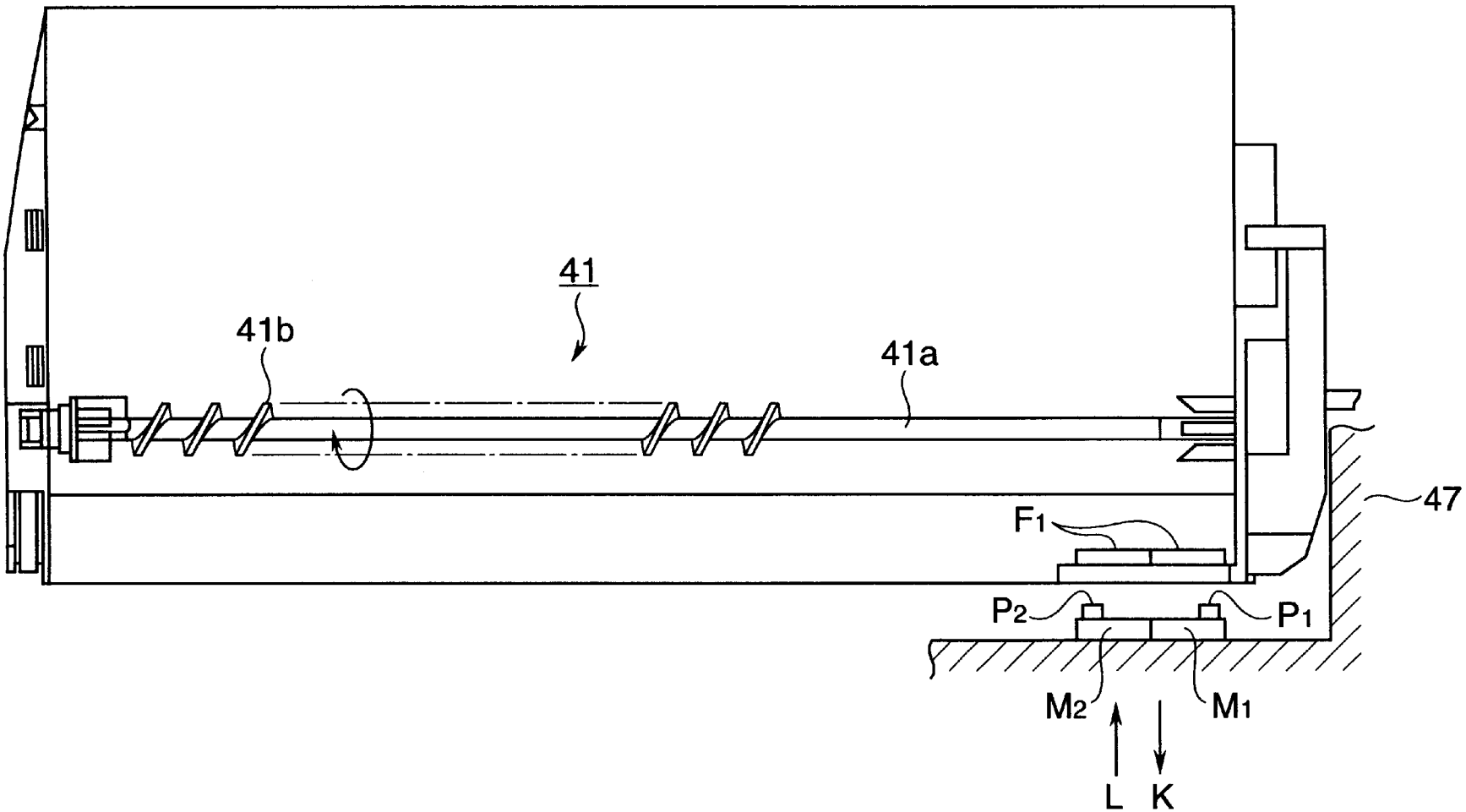
FIG. 8 illustrates a modification of the screw conveyor.

FIG. 8 illustrates a modification of the screw conveyor 24.

Figure 9:
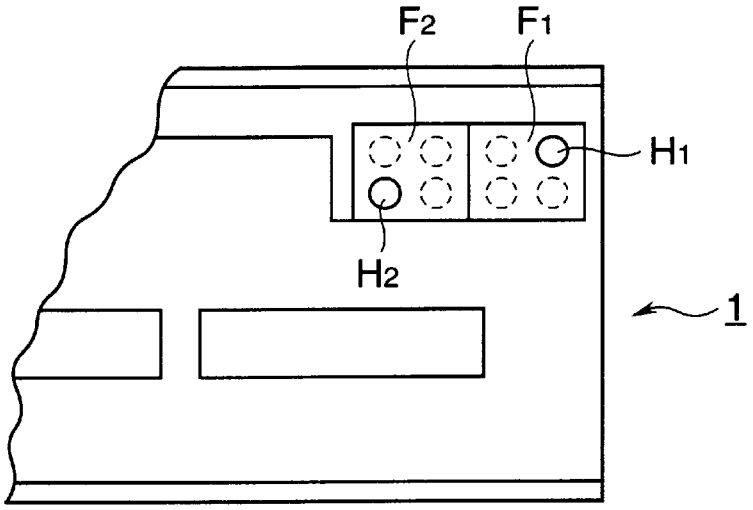
FIG. 9 is a fragmentary bottom view of the toner cartridge as seen in a direction shown by arrow L of FIG. 35.

FIG. 9 is a partial bottom view of the toner cartridge as seen in a direction shown by arrow L of FIG. 8.

Figure 10:
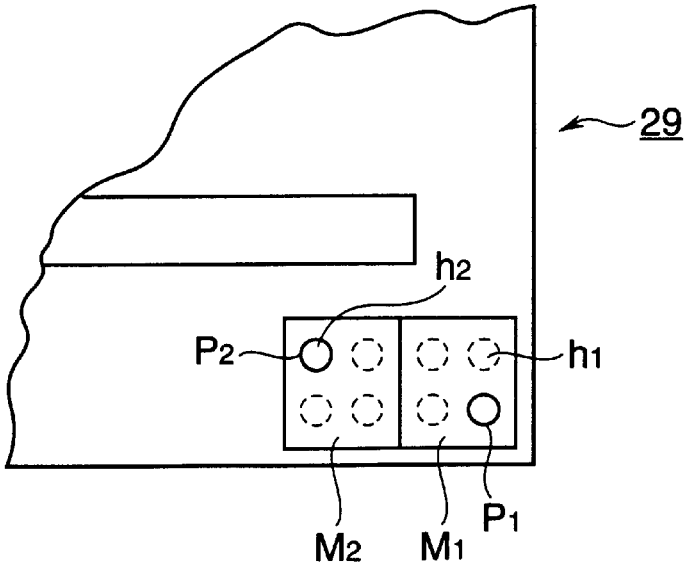
FIG. 10 is a fragmentary top view of the print process cartridge as seen in a direction shown by arrow K of FIG. 35.

FIG. 10 is a fragmentary top view of the print process cartridge 29 as seen in a direction shown by arrow K of FIG. 8.

Referring to FIG. 8, a screw conveyor 41 has a shaft 41*a* and a spiral blade 41*b* formed around the shaft 41*a*. The screw conveyor 41*a* extends substantially in a horizontal direction. It is to be noted that the spiral blade 41*b* is not formed all across the length of the shaft 41*a* but slightly beyond the middle of the shaft 41*a*. Thus, the blade 41*b* conveys the toner to a substantially mid portion of the shaft 41*a* and not to the end of the waste toner chamber 4. This arrangement is advantageous because it prevents toner from piling up against the far wall of the chamber.

Referring to FIG. 9, the toner cartridge 1 has a female piece F1 and a female piece F2 each of which has a hole H1 and a hole H2, respectively.

Referring to FIG. 10, the print process cartridge has a male piece M1 and a male piece M2 each of which has a hole h1 and h2, respectively.

The positions of the hole H1 of the female piece F1 and the pin P1 of the male piece M1 are selected such that a particular position indicates a particular color of toner. In the embodiment, the holes may be formed at four different locations (including dotted circles) as shown in FIGS. 9 and 10.

The positions of the hole H2 of the female piece F2 and the pin P2 of the male piece M2 are selected depending on the product grade or customer. In other words, a particular position indicates a particular product grade or customer.

The pins P1 and P2 fit into the holes H1 and H2 of the toner cartridge, respectively, in mating engagement only when the toner cartridge matches in color with a mounting location on the print process cartridge. That is, the female pieces F1 and the male pieces M1 form a polarizer while the female piece F2 and the male piece M2 form another polarizer.

If the toner cartridge is misplaced, the pins P1 and P2 of the print process cartridge do not fit into the holes H1 and H2 of the toner cartridge, respectively, thereby preventing the inadvertent misplacement of toner cartridges in the print process cartridge. The holes h1 and h2 receive pins P1 and P2 therein, respectively. The pins P are selectively inserted into the holes h according to color of toner and product grade or market at the time of manufacture.

Although the embodiment shows a case in which only one combination of pin and hole, any number of combinations of pins and holes may be employed, up to four in this embodiment. For example, a polarizer formed of the female piece F1 and male piece M1 may use two pins P and two holes H. Likewise, a polarizer formed of the female piece F2 and male piece M2 may use three pins P and three holes H.

{Entrance of Waste Toner Chamber}

Figure 11:
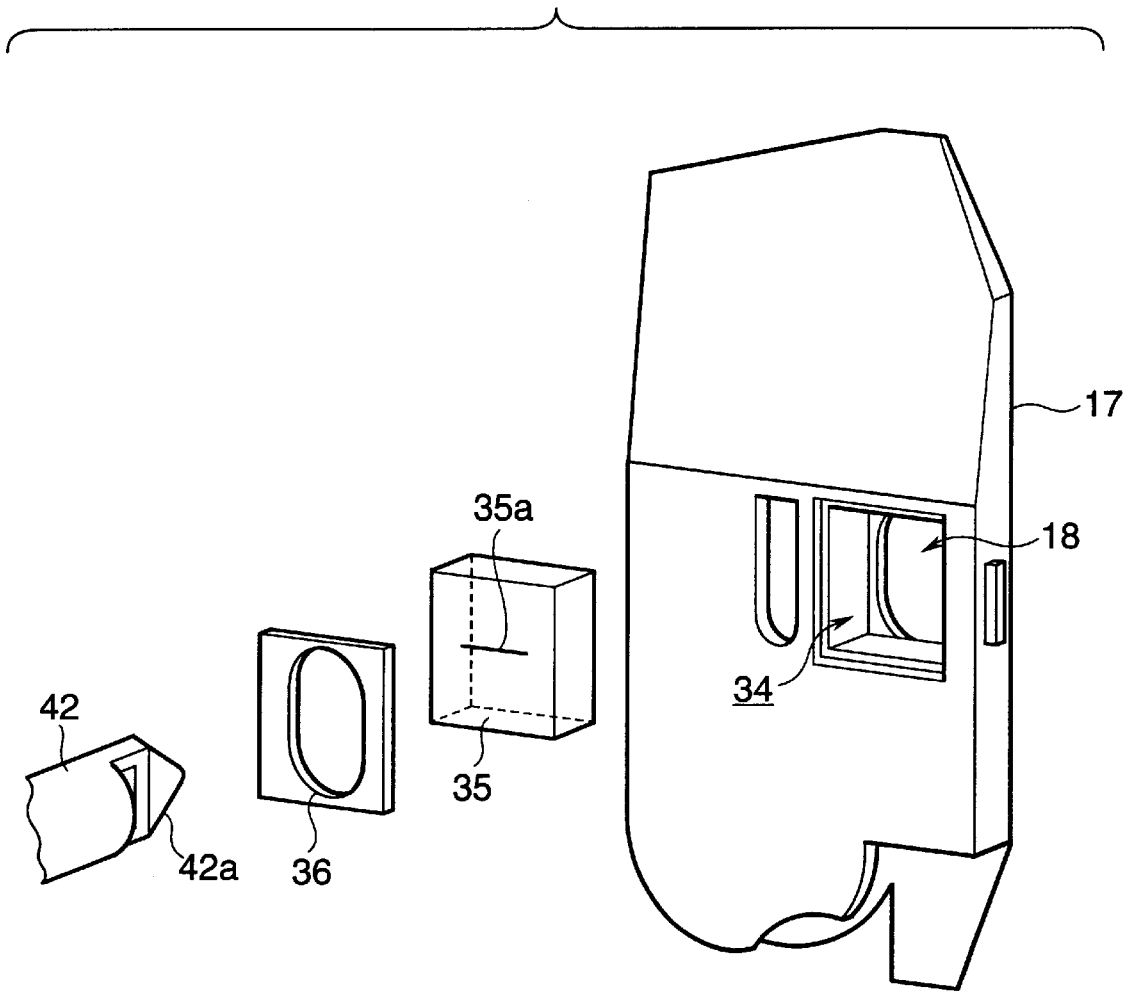
FIG. 11 is an exploded perspective view of the side plate and foamed sponge.

FIG. 11 is an exploded perspective view of the side plate and a foamed sponge.

Referring to FIG. 11, the side plate 17 is formed with the opening 18 and a support portion 34 into which a resilient foamed sponge 35 is fitted. The foamed sponge 35 has a thickness of about several millimeters and prevents the waste toner from falling. An outer cover 36 is mounted to the side plate 17 and holds the foamed sponge 35 in position. The foamed sponge 35 is formed with a slit 35*a* therein at a location into which the waste toner exit 42 of the print process cartridge enters the foamed sponge 35. The slit 35*a* extends in a direction perpendicular to the inclined surface 42*a* of the waste toner exit 42. The length of the slit 35*a* is little shorter than ½ of the outer circumference of the waste toner exit 42.

The operations for mounting the toner cartridge 1 to and dismounting the toner cartridge 1 from the print process cartridge will be described.

First, the user holds the toner cartridge 1 with the toner cartridge 1 inclined in a similar way to that shown in FIG. 6 and lowers the toner cartridge 1 until the opening 18 receives the tip of the waste toner exit 42 of the print process cartridge 29. When the tip of the waste toner exit 42 enters the opening 18, the user lowers the knob side of the toner cartridge 1 so that the toner cartridge 1 extends horizontal. At this stage, the projection 31 of the print process cartridge 29 fits into the recess 22 of the side plate 17 so that the toner cartridge 1 is securely held in the print process cartridge 29. Thus, the toner cartridge is prevented from rotating relative to the print process cartridge or being pulled out the print process cartridge. The inclined surfaces 42*a* of the waste toner exit 42 forcibly enters into the slit 35*a* formed in the foamed sponge 35. Since the length of the slit 35*a* is shorter than the circumference of the waste toner exit 42, the foamed sponge holds the waste toner exit 42 resiliently tightly to provide good sealing effect. Thus, the waste toner is prevented from leaking from the waste toner exit 42.

When the toner cartridge 1 is disconnected from the waste toner exit 42, the foamed sponge 35 regains its original shape, i.e., closes due to its resiliency, preventing the waste toner from leaking through the opening 18. Thus, the foamed sponge 35 eliminates the need for a complicated shutter mechanism but provides a simple, reliable means for preventing toner leakage.

{First Modification of the Entrance of Waste Toner Chamber}

A first modification of the entrance of the waste toner chamber further increases the sealing effect of the foamed sponge and prevents the foamed sponge from rolling up.

Figure 12:
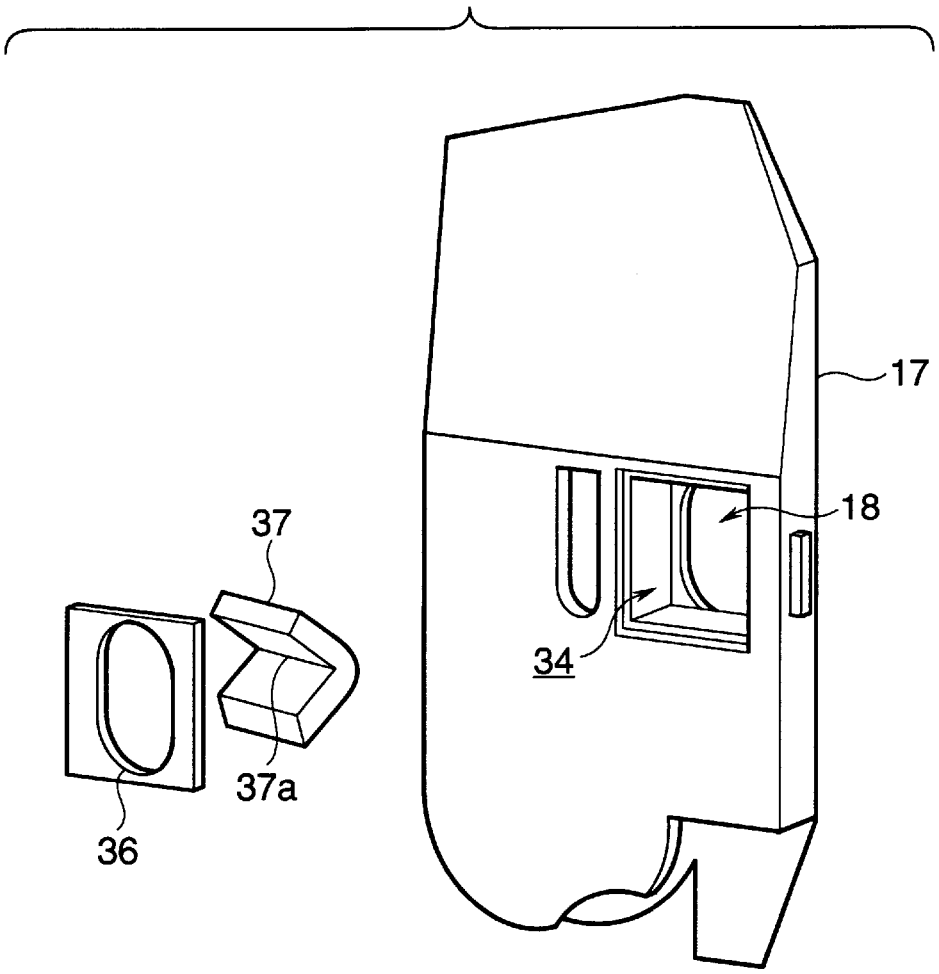
FIG. 12 is an exploded perspective view of the side plate and a foamed sponge according to a first modification of the entrance of the waste toner chamber.

FIG. 12 is an exploded perspective view of the side plate 17 and a foamed sponge 37 according to the first modification of the entrance of waste toner chamber 4.

Figure 13:
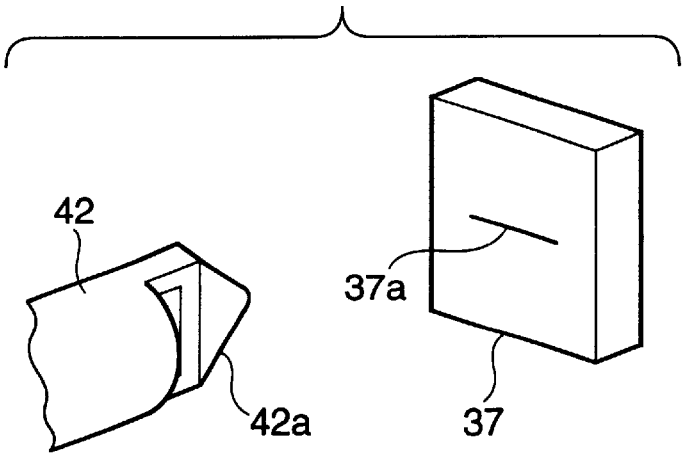
FIG. 13 is a perspective view illustrating the foamed sponge of FIG. 12.

FIG. 13 is a perspective view illustrating the foamed sponge 37.

Figure 14:
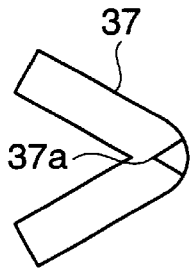
FIG. 14 is a side view illustrating the foamed sponge of FIG. 12.

FIG. 14 is a side view illustrating the foamed sponge 37.

Referring to FIG. 12, the side plate 17 is formed with a support portion 34 therein and has the opening 18. The foamed sponge 37 in a bent position is fittingly received in the support portion 34. The foamed sponge 37 is resilient and has a thickness of about several millimeters. An outer cover 36 is mounted to the side plate 17 so as to prevent the foamed sponge 37 from dropping out of the support portion 34. The foamed sponge 37 is formed with a slit 37*a* therein at a location into which the waste toner exit 42 of the print process cartridge 29 enters the toner cartridge 1. The slit 37*a* extends in a direction perpendicular to the direction in which the inclined surfaces 42*a* of the waste toner exit 42 extend. The length of the slit 35*a* is little shorter than ½ of the outer circumference of the waste toner exit 42 so that the resiliency of the foamed sponge 35 provides good sealing effect.

When the foamed sponge 37 is mounted into the support portion 34, the foamed sponge 37 bent into a V-shape is mounted such that the foamed sponge tapers in the direction of insertion of the waste toner exit 42. The V-shaped foamed sponge 37 provides more force to intimately hold the waste toner exit 42 than a foamed sponge not bent into a V-shape, so that the foamed sponge 37 does not roll up.

The operation for attaching the toner cartridge 1 to and detaching the toner cartridge 1 from the waste toner exit 42 will be described.

The operation is the same as the first modification of the entrance of waste toner chamber until the toner cartridge 1 is secured to the print process cartridge 29 and therefore the description thereof is omitted.

When the toner cartridge 1 has been secured to the print process cartridge 29, the waste toner exit 42 forcibly opens the slit 37*a* in the foamed sponge 37 and enters the foamed sponge 37. Since the V-shaped foamed sponge 37 has a large force to intimately hold the waste toner exit 42, the slit 37*a* will not open wide so that the foamed sponge does not roll up or turn up near the slit 37*a*. Thus, the waste toner exit 42 smoothly enters the slit 37*a*. The length of the slit 37*a* is shorter than the outer circumference of the waste toner exit 42 so that the waste toner will not leak through the gaps when the waste toner exit 42 enters the slit 37*a*.

When the toner cartridge 1 is disconnected from the waste toner exit 42, the foamed sponge 37 sufficiently closes the slit 37*a* to prevent the waste toner from leaking. The V-shaped foamed sponge 37 holds the waste toner exit 42 resiliently intimately so that when the waste toner exit 42 is pulled out of the foamed sponge 37, there will no be significant gaps therebetween. Thus, the waste toner exit 42 smoothly enters the slit 37*a*.

{Second Modification of Entrance of Waste Toner Chamber}

Figure 15:
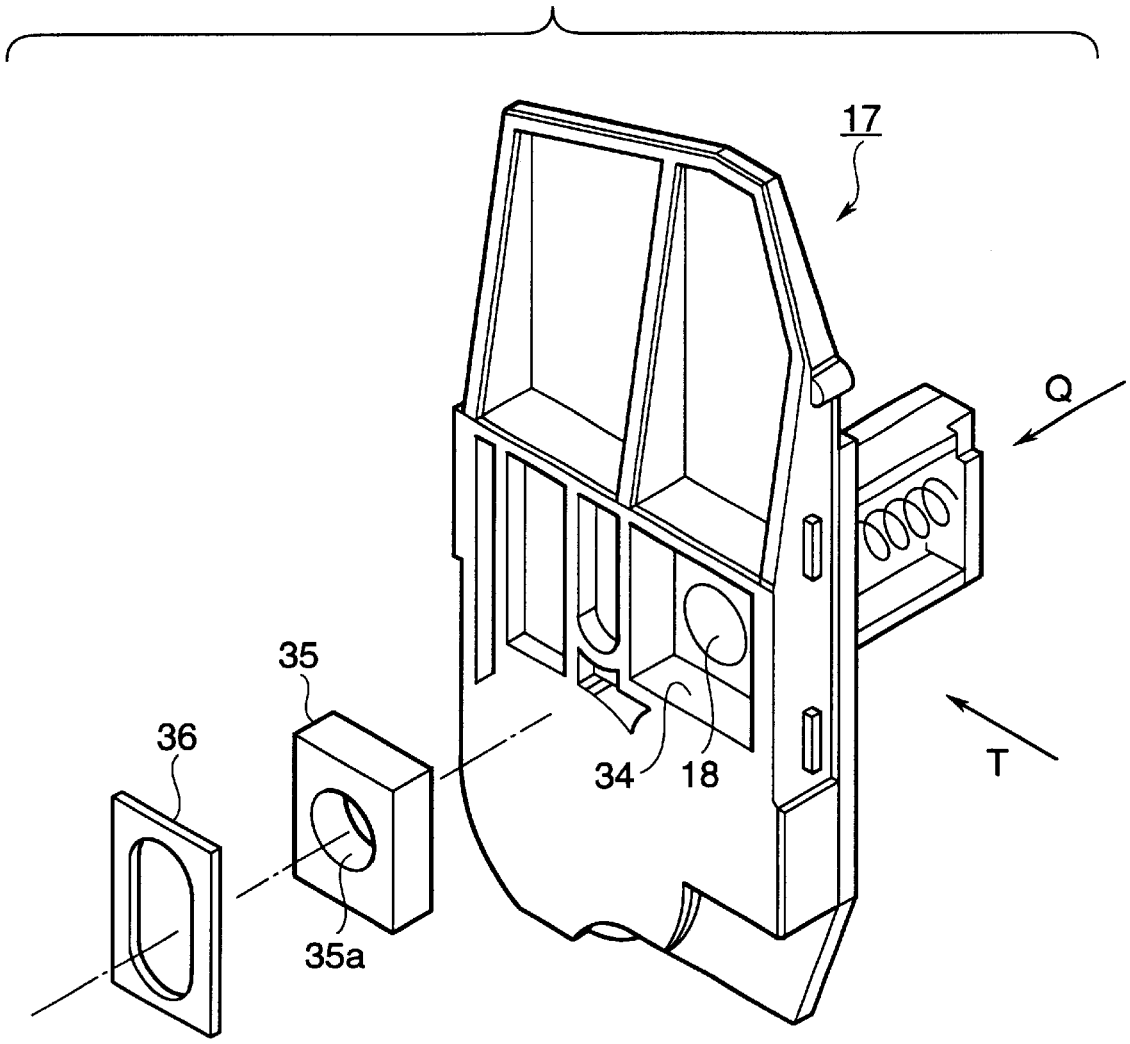
FIG. 15 is a perspective view of a side plate of a second modification of the entrance of the waste toner chamber.

FIG. 15 is a perspective view of a modification of the side plate.

Referring to FIG. 15, a side plate 17 is formed with a support portion 34 into which a foamed sponge 35 is fitted. The foamed sponge 35 has a thickness of about several millimeters. The outer cover 36 is attached to the side plate 17 so as to hold the foamed sponge 35 in the support portion 34. The foamed sponge 235 has a hole 35*b* formed therein through which a later described waste toner exit 42 (FIG. 18) of the print process cartridge extends.

Figure 16:
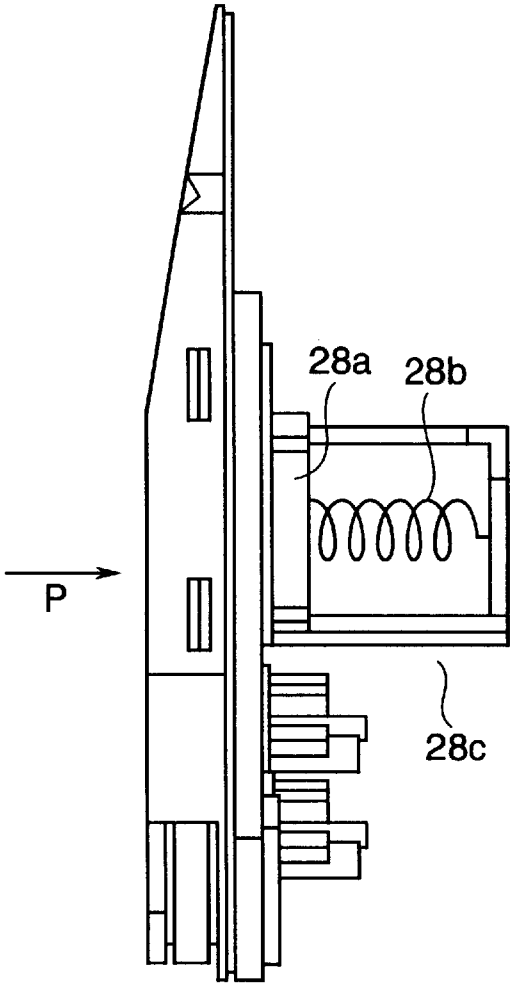
FIG. 16 is a side view of the side plate as seen in a direction shown by arrow T of FIG. 18.
Figure 18:
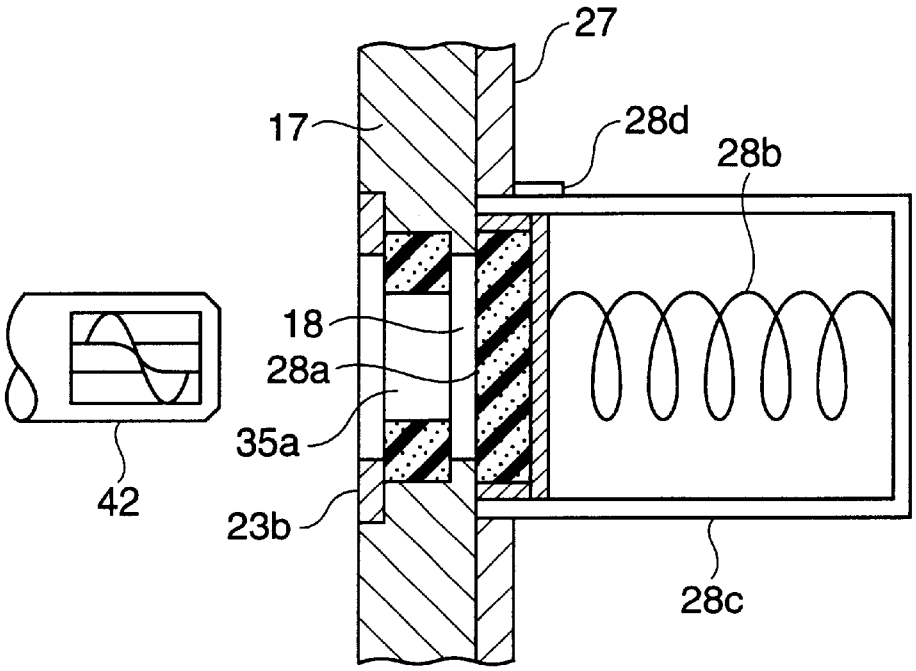
FIGS. 18–19 are partial cross-sectional views of the opening/closing mechanism.

FIG. 16 is a side view of the side plate 17 as seen in a direction shown by arrow T of FIG. 18.

Figure 17:
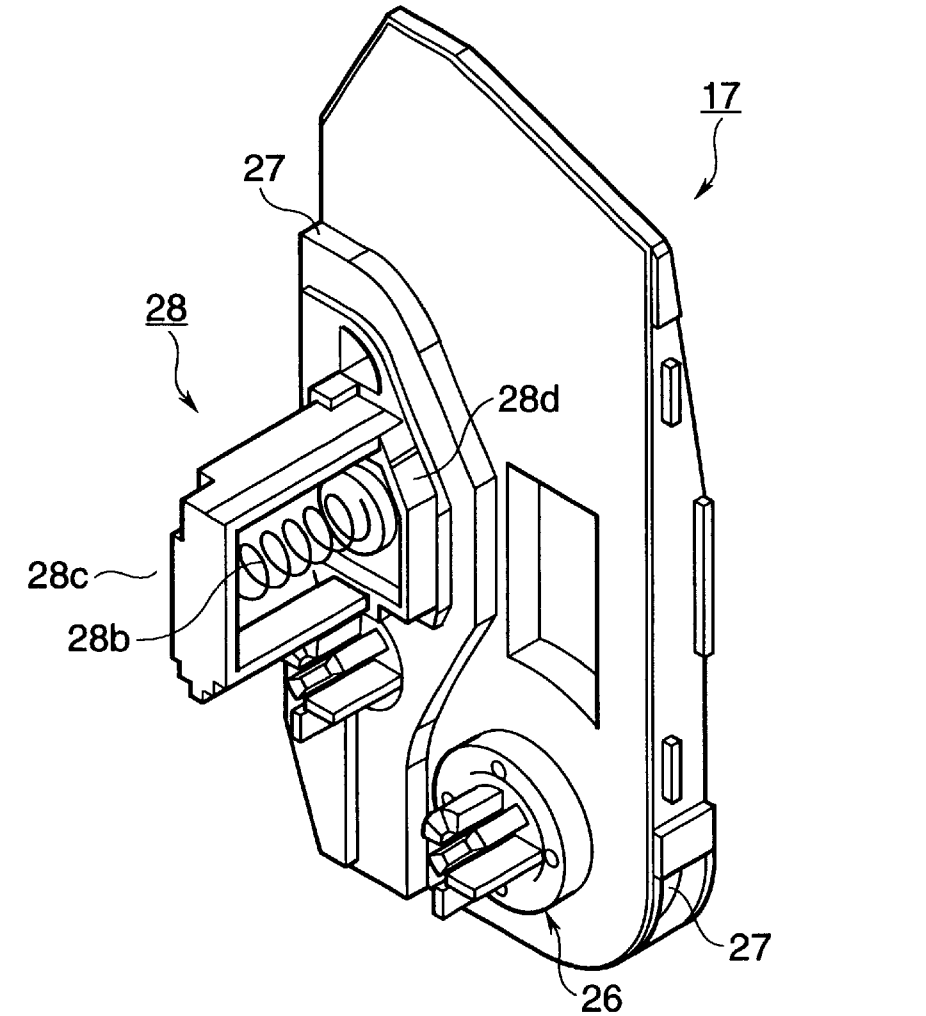
FIG. 17 is a perspective view of the side plate when it is seen in a direction shown by arrow Q of FIG. 15.

FIG. 17 is a perspective view of the side plate 17 when it is seen in a direction shown by arrow Q of FIG. 15.

The side plate 17 has an inner plate 27 assembled thereto.

Figure 19:
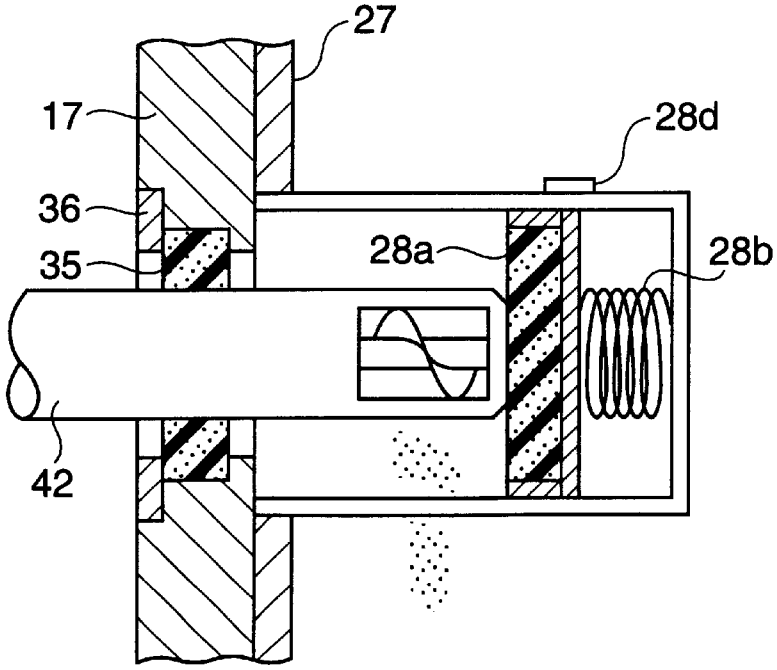

FIGS. 18–19 are partial cross-sectional views of the opening/closing mechanism 28.

Referring to FIG. 18, the inner plate 27 has an opening/closing mechanism 237 that includes a U-shaped rail 28*c*, a spring 28*b*, and a polyurethane sponge 28*a*. The spring 28*b* is mounted between the polyurethane sponge 28*a* and U-shaped rail 28*c* and urges the polyurethane sponge 28*a* toward the opening 18.

When the waste toner exit 42 has moved out of the toner cartridge, the polyurethane sponge 28*a* is urged by the spring 28*b* against the inner surface of the inner plate 27, thereby completely closing the waste toner chamber.

As shown in FIG. 19, when the waste toner exit 42 moves into the toner cartridge, the waste toner exit 42 pushes the polyurethane sponge 28*a* against the urging force of the spring 28*b* into the waste toner chamber. As a result, the polyurethane sponge 28*a* yieldably moves into the waste toner chamber. The foamed sponge 35 is in intimate contact with the outer circumferential surface of the toner exit 42, thereby providing a seal against the environment.

{Third Modification of the Entrance of Waste Toner Chamber}

A toner cartridge having a third modification of the entrance of waste toner also has a fresh toner chamber and a waste toner chamber but is of a somewhat different structure.

Figure 20:
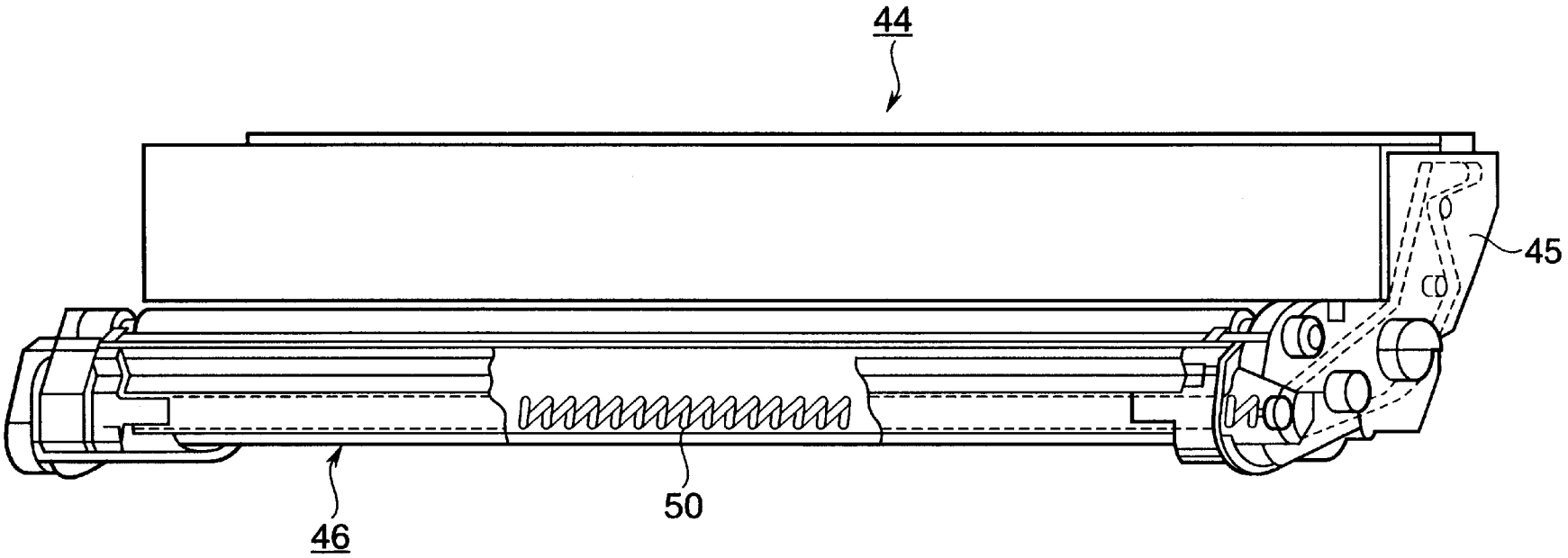
FIG. 20 is a perspective view of another print process cartridge according to a third modification of the entrance of the waste toner chamber.

FIG. 20 is a perspective view of another print process cartridge.

Figure 21:
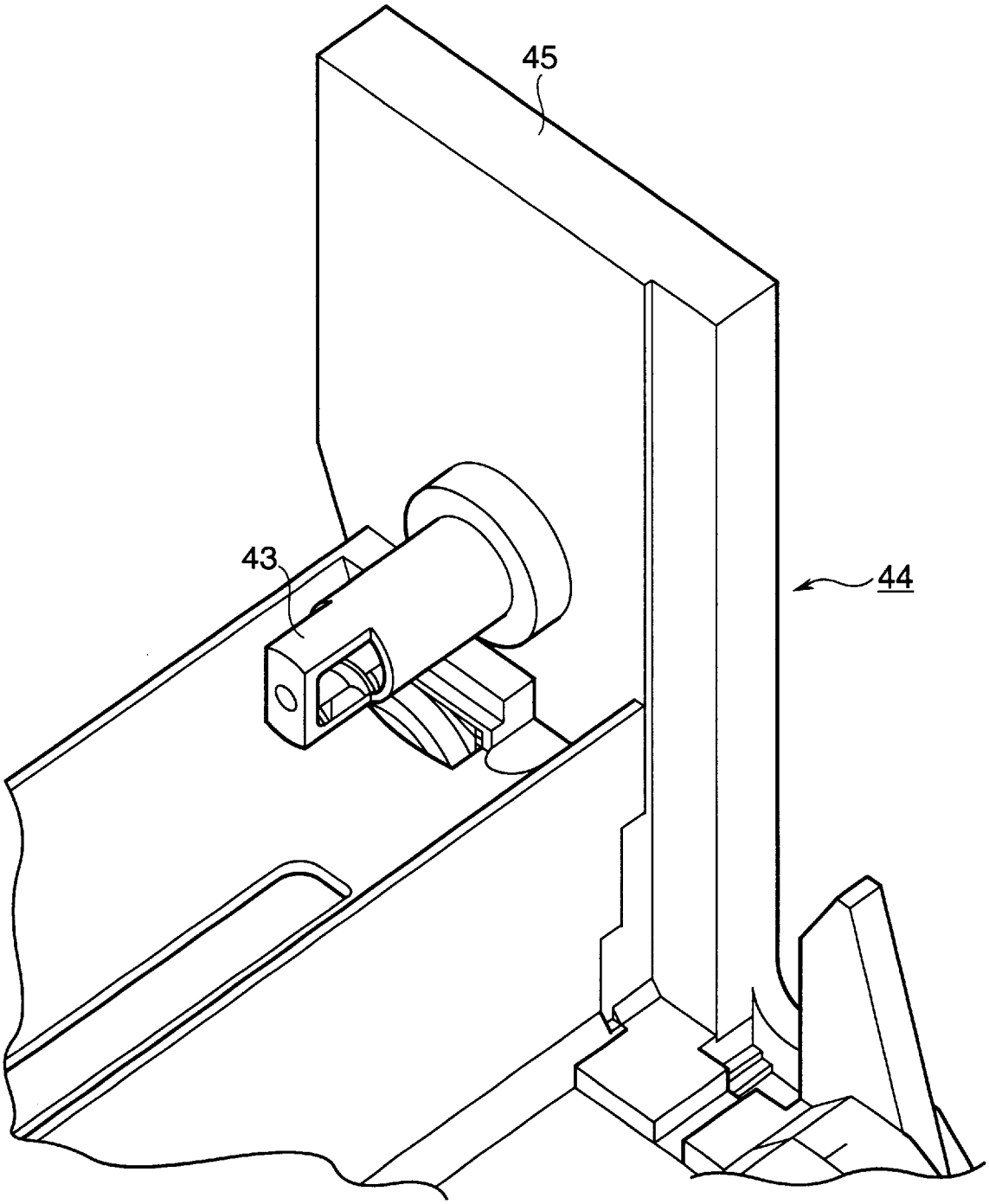
FIG. 21 is a perspective view illustrating the waste toner exit of the print process cartridge.

FIG. 21 is a perspective view illustrating the waste toner exit 43 of the print process cartridge.

Figure 22:
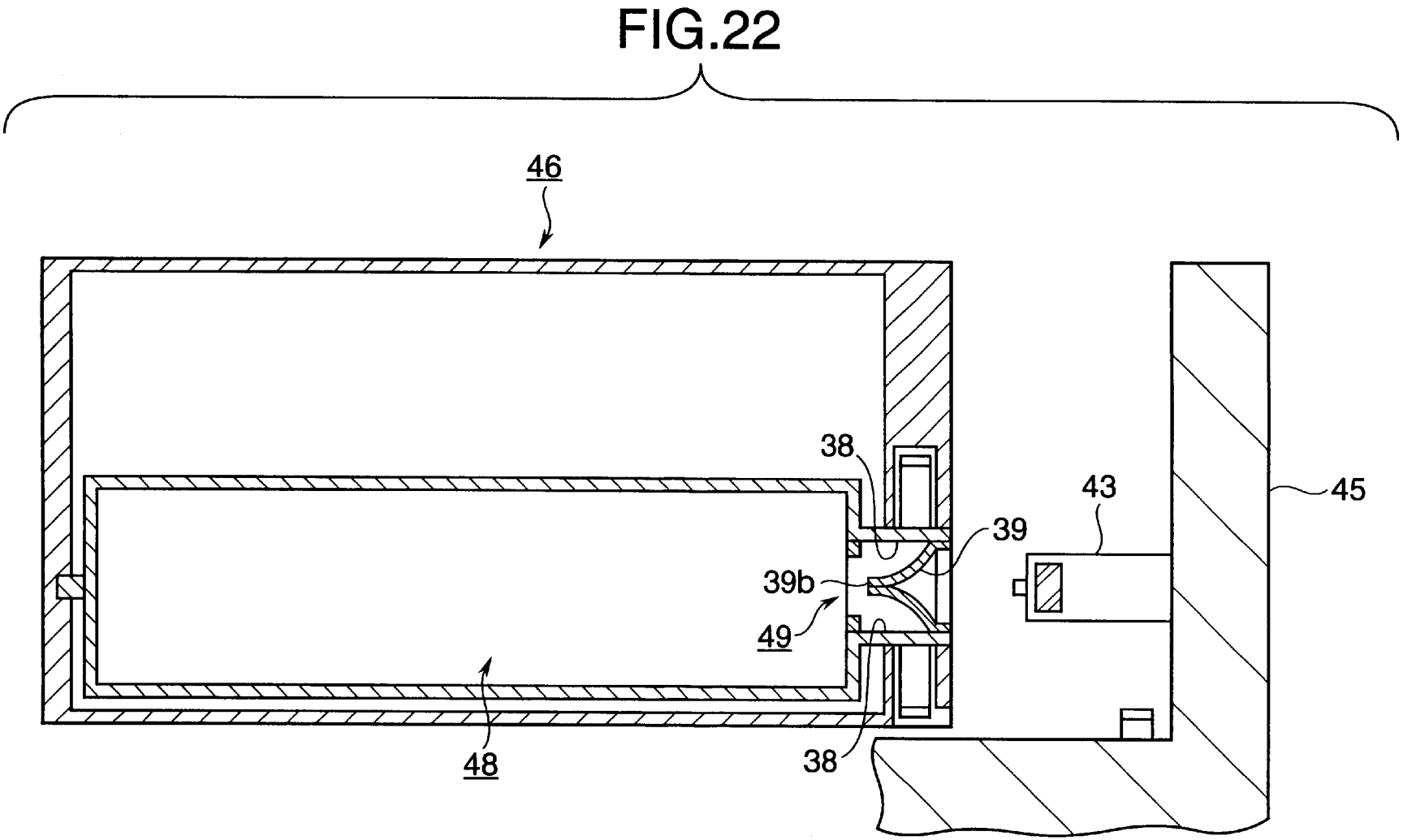
FIG. 22 is a cross-sectional view of a toner cartridge according to the third modification of the entrance of the waste toner chamber.

FIG. 22 is a cross-sectional view of the toner cartridge having a modified entrance of the waste toner chamber.

Figure 23:
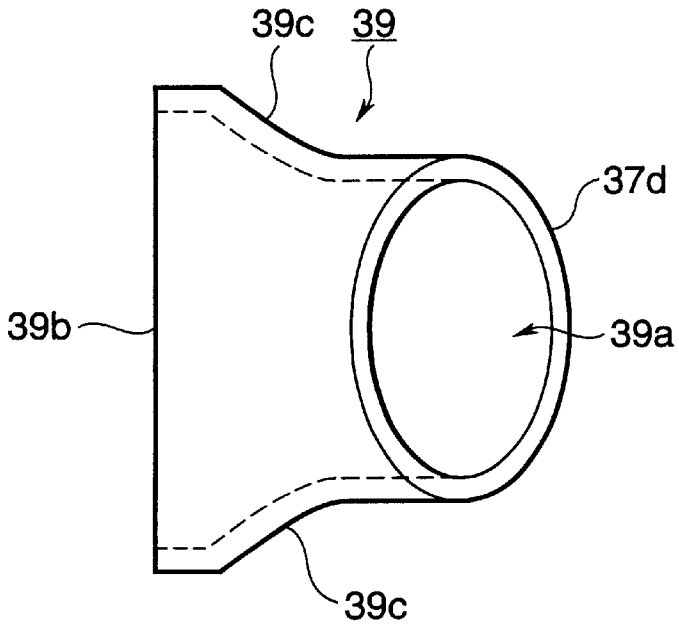
FIGS. 23 and 24 are perspective views showing a sealing member according to the third modification of the entrance of the waste toner chamber.
Figure 24:
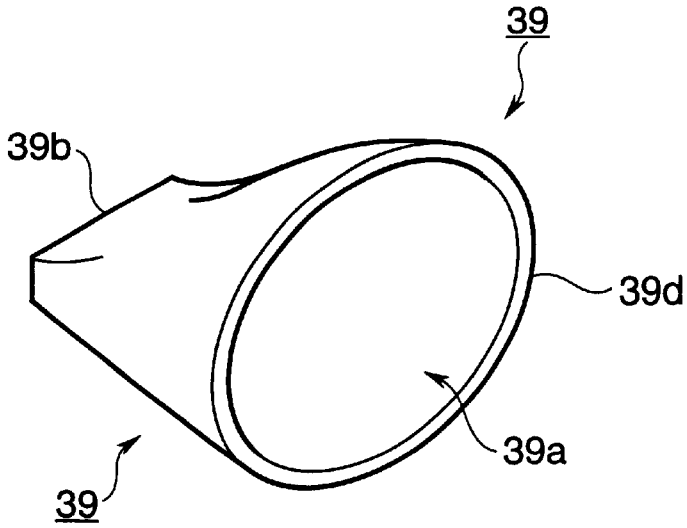

FIGS. 23 and 24 are perspective views showing a modified sealing member.

Referring to FIGS. 20 and 21, a side plate 45 of a print process cartridge 44 has a waste toner exit 43 (FIG. 21). As shown in FIG. 22, a toner cartridge 46 has an opening 49 through which the waste toner is directed into a waste toner chamber 48. The side plate of the toner cartridge 46 is formed with an entrance 38 therein. A short, flexible sleeve-like sealing member 39 is mounted to the entrance 38 with one end 39*d* of the sealing member 39 secured to an inner circumferential wall of the entrance 38. The sealing member 39 is made of a resilient material and prevents the waste toner from leaking from the toner cartridge 46 when the toner cartridge 46 has been disconnected from the waste toner exit 43. The sealing member 39 also prevents gaps from being created between the waste toner exit 43 and the sealing member 39.

As shown in FIGS. 22–24, the sealing member 39 has a circular opening 39*a* at the upstream of the insertion direction of the waste toner exit 43. The opening 39*a* becomes narrower with increasing distance from the circular opening 39*a* and is completely closed at a closed portion 39*b*, thereby closing the opening 49. The closed portion 39*b* is opened when the waste toner exit 43 forcibly enters therethrough and is closed when the waste toner exit 43 is pulled out.

The sealing member 39 is made of, for example, a cylindrical tube with one end deformed, for example, by heat into the closed portion 39*b*. The sealing member 39 may also be made by welding opposed ends of two sheets of polyester film placed together, and then attaching one of the opposed openings of the welded polyester to a separate ring-shaped member as the opening 39*a*.

As shown in FIG. 20, a screw conveyor 50 is assembled within the waste toner chamber 48.

The operation for attaching the toner cartridge 46 to and detaching the toner cartridge 46 from the waste toner exit 43 will be described.

The user holds the toner cartridge 46 oblique and lowers the toner cartridge 46 until the opening 49 receives the waste toner exit 43 of the print process cartridge 44. When the tip of the waste toner exit 43 enters the sealing member 39, the knob side of the toner cartridge 46, not shown, is lowered so that the toner cartridge 1 extends horizontal. At this stage, the waste toner exit 43 enters the entrance 38 through the opening 39*a* of the sealing member 39 and then further into the sealing member 39 to forcibly open the closed portion 39*b*. Then, the waste toner exit 43 enters the opening 49.

When the toner cartridge 46 is disconnected from the waste toner exit 43, the waste toner exit 43 comes out of the sealing member 39 so that the sealing member 39 regains its original shape and the closed portion 39*b* remains closed. After the toner cartridge 46 has been disconnected from the waste toner exit 43, the closed portion 39*b* prevents the waste toner from leaking through the opening 49.

{Fourth Modification of the Entrance of Waste Toner Chamber}

A toner cartridge having a fourth modification of the entrance of waste toner is basically of the same structure as the third modification.

Figure 25:
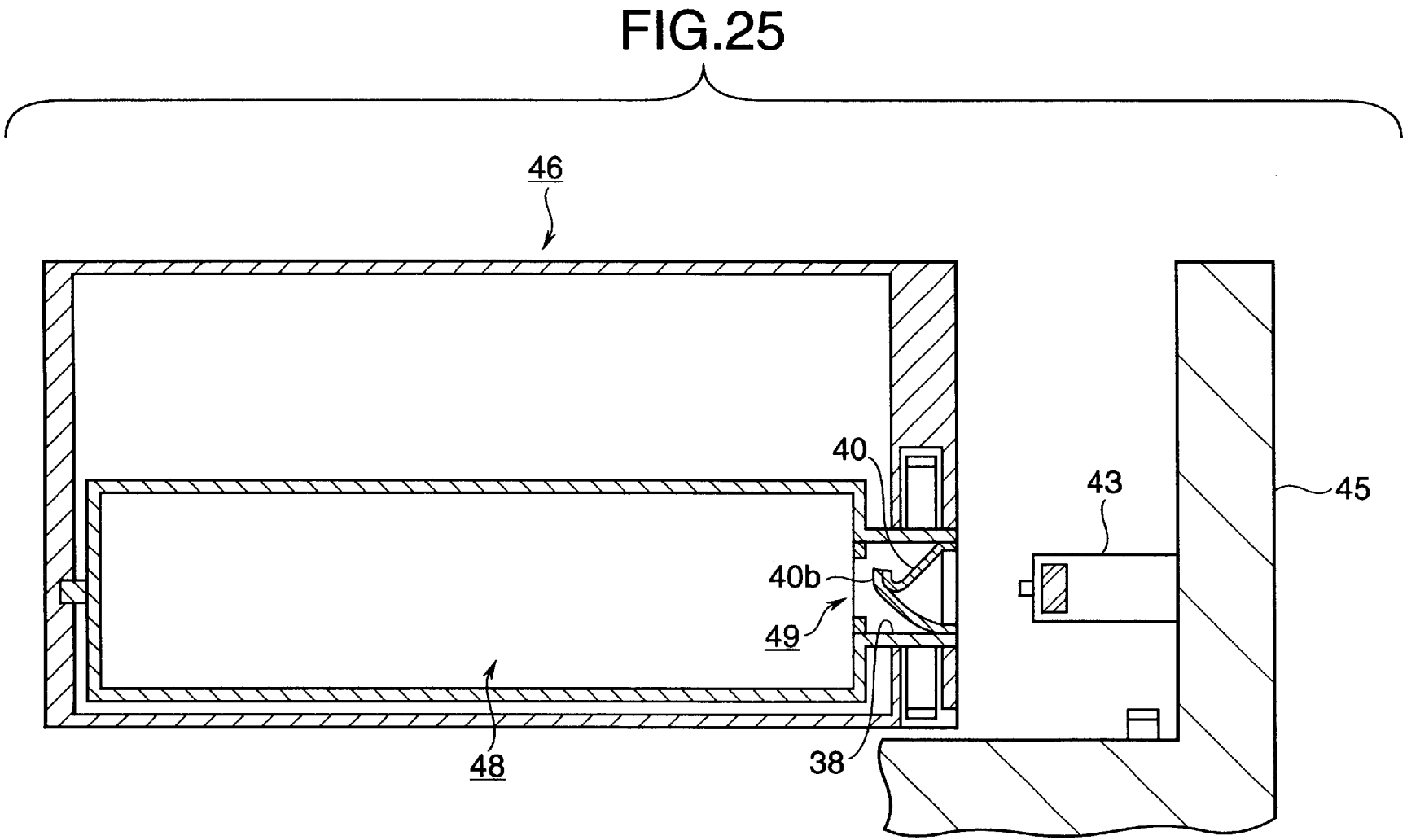
FIG. 25 is a cross-sectional view of a toner cartridge according to a fourth modification of the entrance of the waste toner chamber.

FIG. 25 is a cross-sectional view of a toner cartridge according to a fourth modification of the entrance of waste toner chamber.

Figure 26:
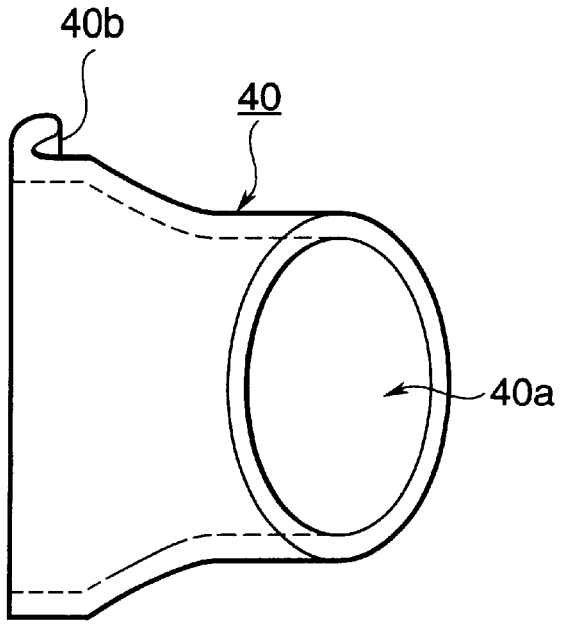
FIGS. 26 and 27 are perspective views of a sealing member.
Figure 27:
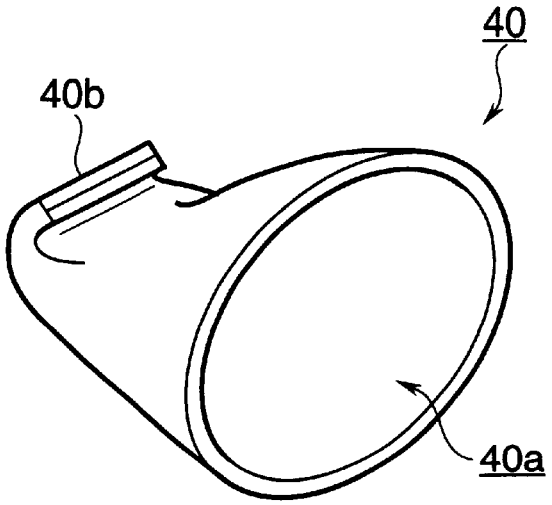

FIGS. 26 and 27 are perspective views of a sealing member of FIG. 25.

Figure 28:
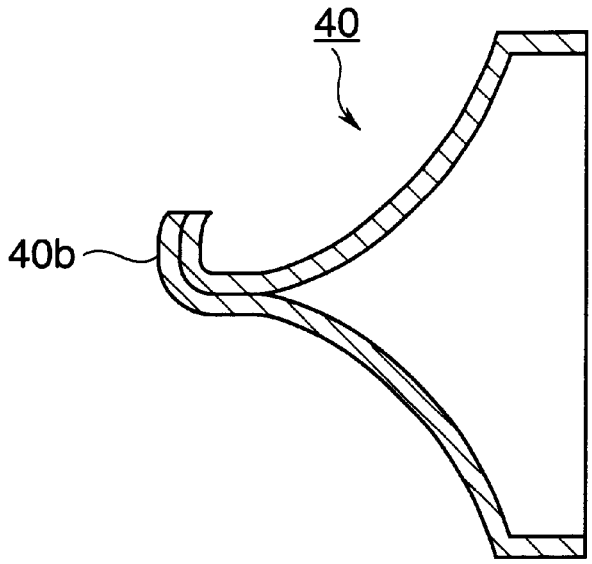
FIGS. 28 and 29 are cross-sectional side views of the sealing member.
Figure 29:
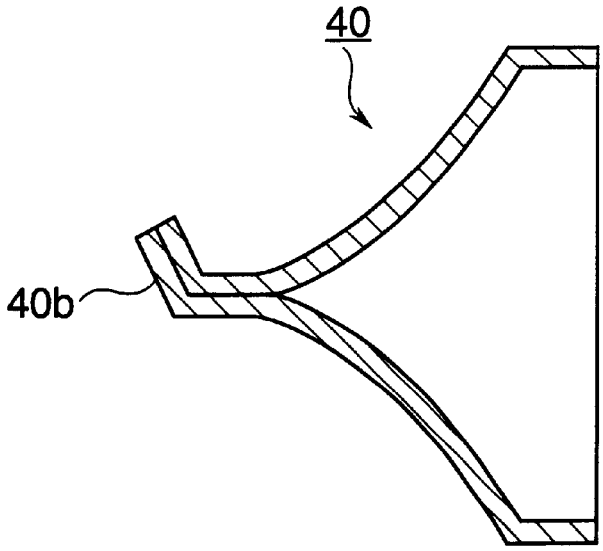

FIGS. 28 and 29 are cross-sectional side views of the sealing member of FIG. 25.

Figure 30:
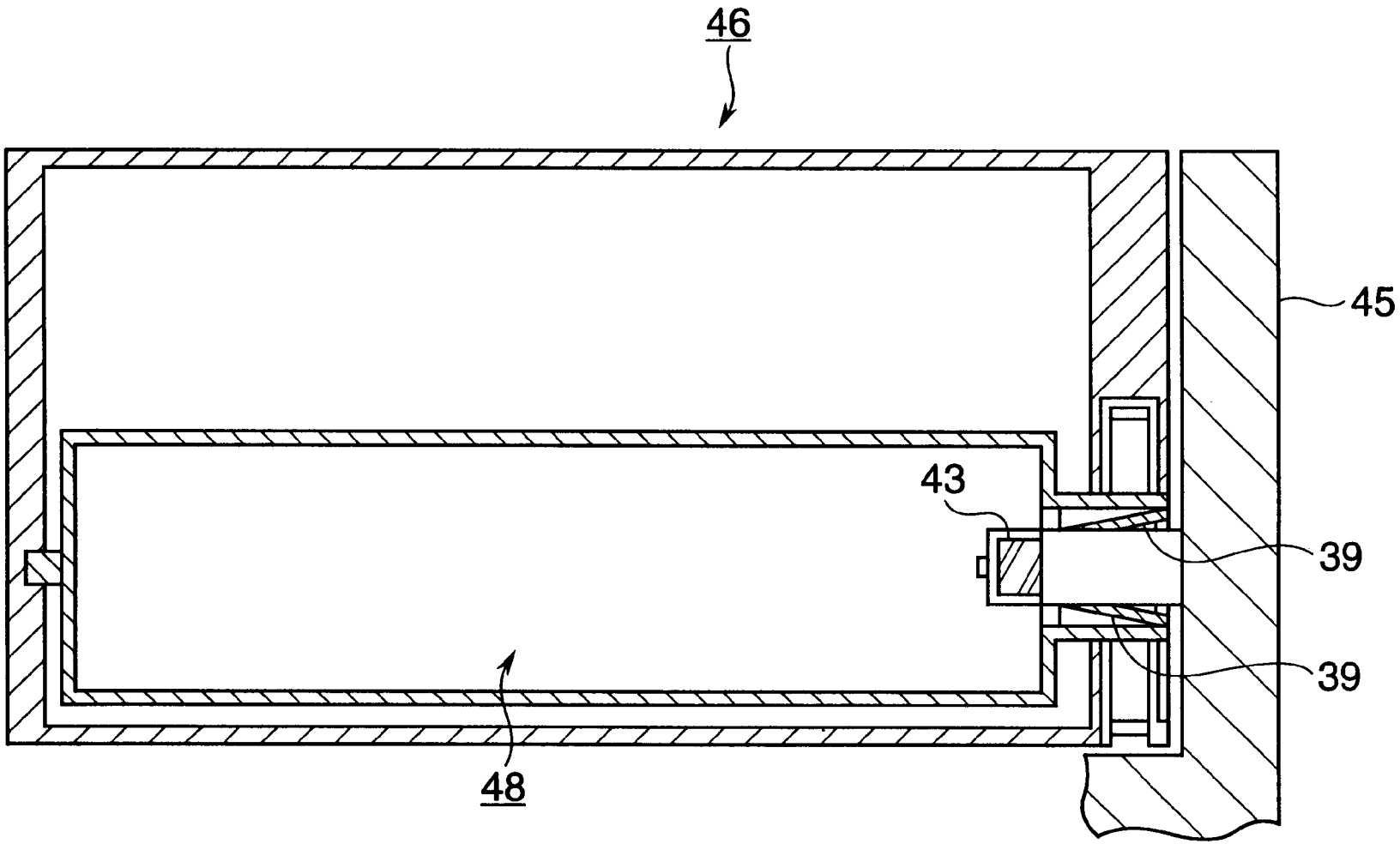
FIG. 30 is a cross-sectional view of the toner cartridge according to a fourth modification of the entrance of the waste toner chamber.

FIG. 30 is a cross-sectional view of the toner cartridge of FIG. 25.

Referring to FIG. 28, the sealing member 40 according to the fourth modification is similar to that of the third modification and has a folded portion 40*b*. The folded portion 40*b* may be of a continuously rounded shape or creased as shown in FIG. 29. Forming the closed portion 40*b* by folding increases the sealing effect of the closed portion 40*b*.

The rest of the construction of the fourth modification is the same as that of the third modification and the description thereof is omitted.

The operation for attaching the toner cartridge 46 to and detaching the toner cartridge 46 from the waste toner exit 43 will be described.

The user holds the toner cartridge 46 oblique and lowers the toner cartridge 46 until the opening 49 receives the tip of the waste toner exit 43 of the print process cartridge 44. When the tip of the waste toner exit 43 enters the toner cartridge 46, the user lowers the knob side of the toner cartridge 46, not shown, so that the toner cartridge 1 extends horizontal. At this stage, the waste toner exit 43 enters the entrance 38 through the opening 40*a* of the sealingmember 40 and then further into the sealing member 40 to forcibly open the closed portion 40*b*.

When the toner cartridge 46 is disconnected from the waste toner exit 43, the waste toner exit 43 comes out of the sealing member 40 so that the sealing member 40 regains its original shape and the closed portion 40*b* remains closed.

Since the closed portion 40*b* is folded, the closed portion 40*b* is prevented from remaining open when the waste toner exit 43 has come out of the entrance 38.

In addition to the advantages of the third modification, the fourth modification has the following advantage. The folded closed portion 40*b* ensures that when the waste toner exit 43 is not inserted into the entrance 38, the closed portion 40*b* is firmly closed. A folded portion offers better sealing effect than a non-folded portion.

The waste toner chamber may not extend across the entire longitudinal length.

{Locking Mechanism of Operating Knob}

The toner cartridge shown in FIG. 1A may have a operating lever with a locking mechanism.

Figure 31:
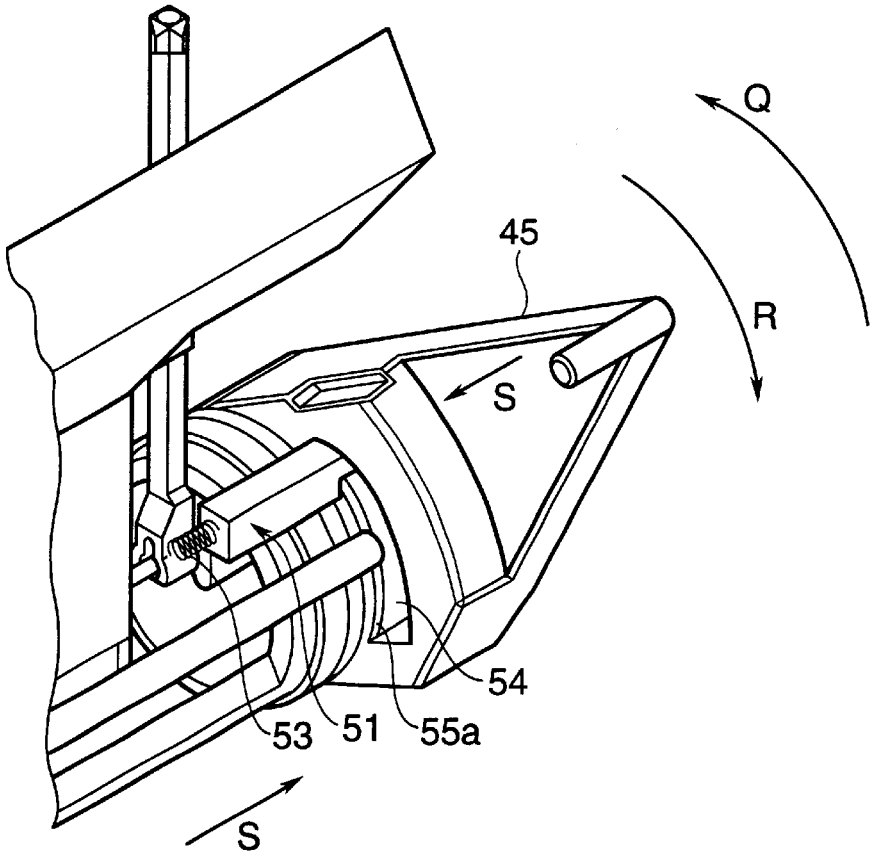
FIG. 31 illustrates an operating lever and associated mechanisms of a locking mechanism.

FIG. 31 illustrates an operating lever 45 and associated mechanisms just before the operating lever 45 is assembled into the toner cartridge 1.

Figure 32:
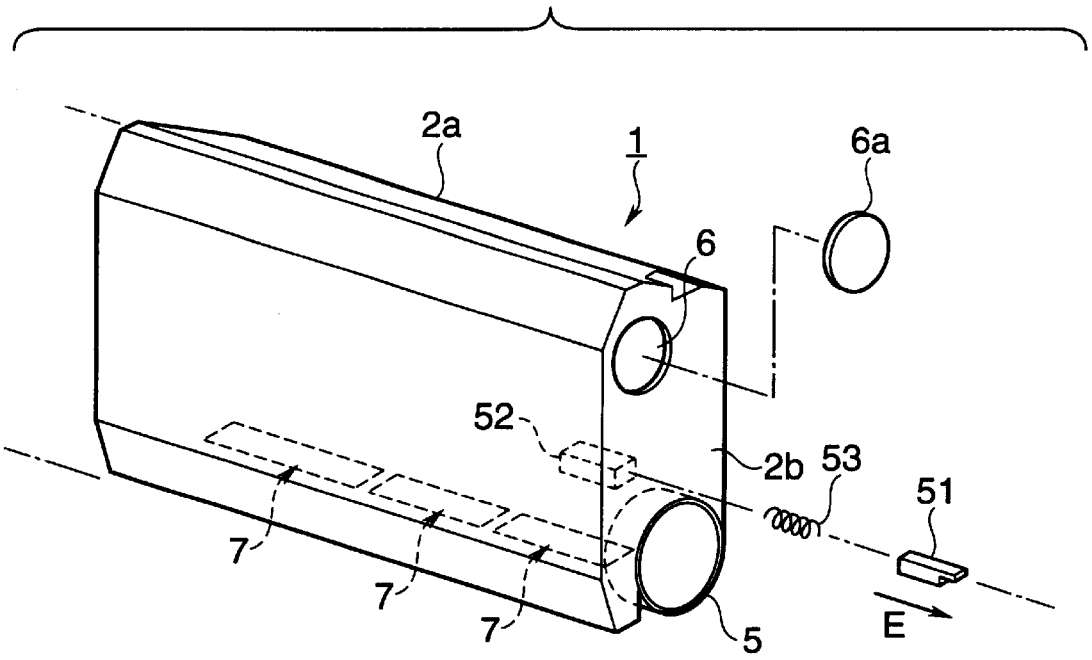
FIG. 32 is a perspective view of the toner cartridge of FIG. 31.

FIG. 32 is a perspective view of the toner cartridge 1.

Figure 33:
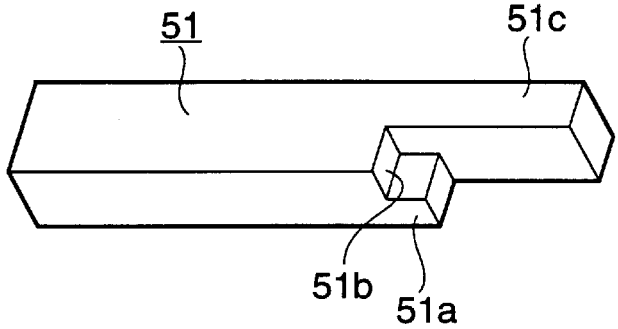
FIG. 33 is a perspective view of a locking bar.

FIG. 33 is a perspective view of a locking bar 51.

Figure 34:
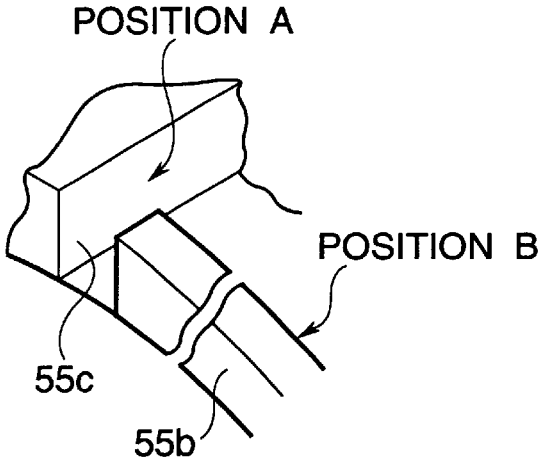
FIG. 34 is a fragmentary perspective view, illustrating position A.

FIG. 34 is a fragmentary perspective view, illustrating positions A and B.

Figure 35:
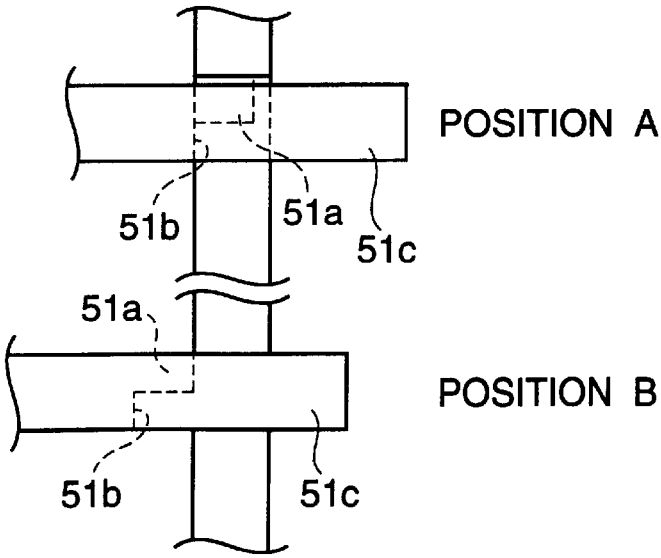
FIG. 35 is a fragmentary top view, illustrating the locking bar at the position A and position B.

FIG. 35 is a fragmentary top view, illustrating the locking bar at the position A and position B.

Referring to FIG. 31, the operating lever 45 has an arcuate opening 54 into which a locking bar 51 extends.

Referring to FIGS. 34 and 35, the operating lever 45 is pivotal between position A and position B. At the position B, the locking bar 51 abuts the ends of the arcuate opening to prevent further pivotal motion of the operating lever 45. When the operating lever 45 has been fully rotated in a direction shown by arrow R, the operating lever 45 is at the position A. When the operating knob 45 has been fully rotated in a direction shown by an arrow Q, the operating lever 45 is at the position B. The operating lever 45 has a recess 55*c* formed at the position A. As shown in FIG. 32, the locking bar 51 has a stepped portion 51*a* and a surface 51*b*.

Referring to FIG. 32, a spring 53 and the locking bar 51 are received in a hole 52 formed in the toner cartridge 1 such that the locking bar 51 is urged by the spring 53 in a direction shown by arrow E. The locking bar 51 moves along the arcuate opening 54 with the stepped portion 51*a* sliding on the side surface 55*b* of the operating knob. Due to the fact that the locking bar 51 is biased by the spring 53, when the operating lever 45 is moved to the position A, the stepped portion 51*a* drops into a recess 55*c* formed in the operating lever 45 to lock the operating lever 45. The position A is equivalent to the position shown in FIG. 1B.

Thus, as is clear from FIG. 35, the tip 51*c* of the locking bar 5 projects more outwardly of the opening 54 when the operating knob 45 is at the position A than when the operating knob 45 at the position B.

The user can push the locking bar 51 toward the toner cartridge 1 and then rotate the operating knob 45 toward the position B while pushing the locking bar, thereby moving the operating lever 45 out of locking engagement with the locking bar 51.

Figure 36:
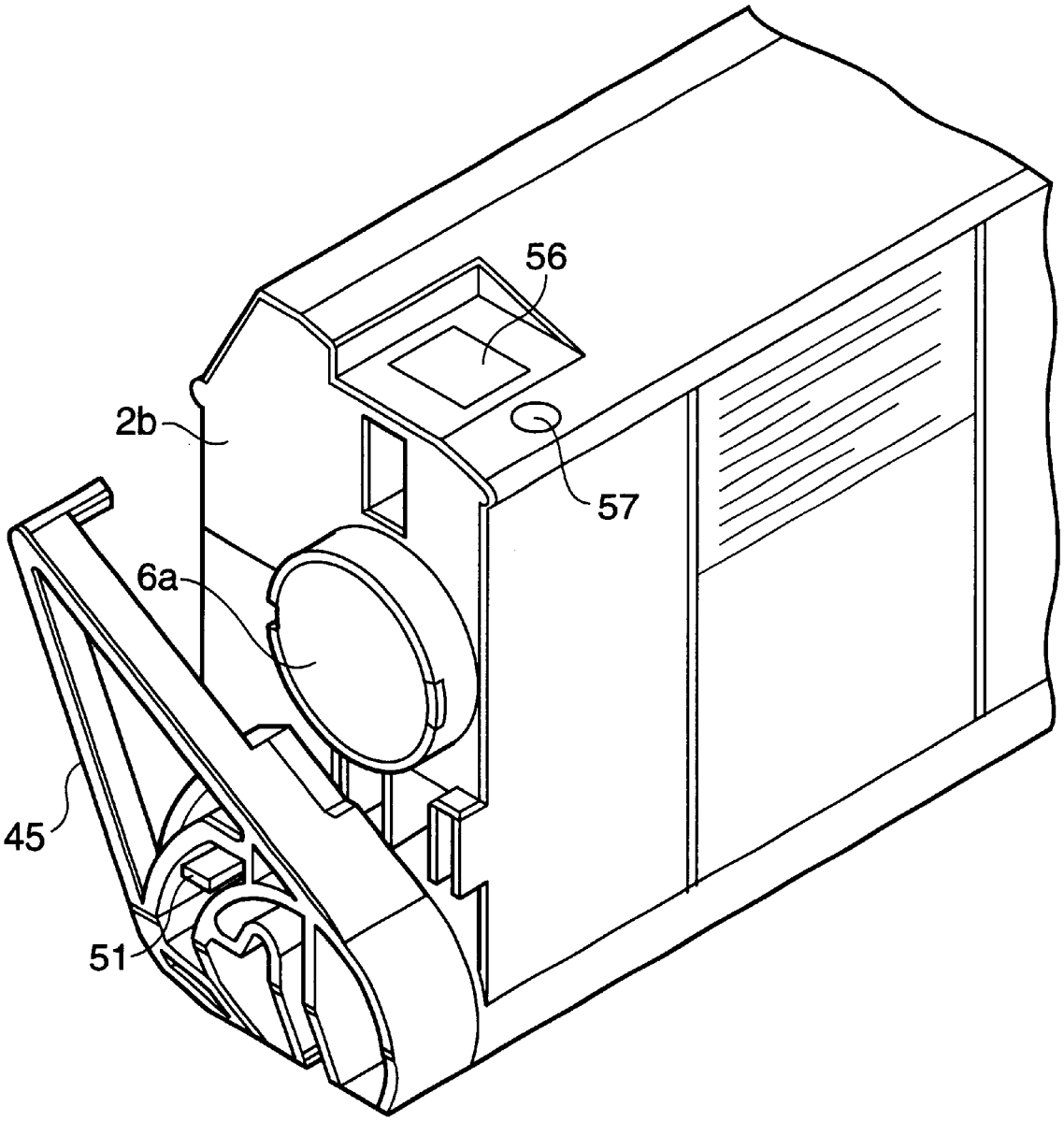
FIG. 36 is a partial perspective view of the operating lever and the toner cartridge of FIG. 31.

FIG. 36 is a partial perspective view of the operating knob 45 and the toner cartridge 1.

Referring to FIG. 36, the toner cartridge 1 has a transparent cover 56 that serves as a "window" through which the user can visually check the toner stored in the fresh toner chamber. The toner cartridge also has a label 57 that indicates the color of the toner contained in the toner cartridge 1. The cap 6*a* is detachably mounted to close the toner-filling opening formed in the side wall 2*b* of the toner cartridge 1. Thus, the user can check the color of the toner either through the transparent cover or by looking at the label 57.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A toner cartridge removably attached to a printer, the toner cartridge extending generally in a longitudinal direction, the toner cartridge comprising:

a housing;

a fresh toner chamber provided in said housing;

a waste toner chamber provided in said housing, said waste toner chamber being at least partly adjacent to said fresh toner chamber; and a partition disposed in said housing, said partition extending in the longitudinal direction to divide an inner space of said housing to define said fresh toner chamber and said waste toner chamber such that said fresh toner chamber and said waste toner chamber extend parallel to each other and are at least partly horizontally adjacent when the toner cartridge has been attached to the printer.

2. The toner cartridge according to claim 1, wherein said fresh toner chamber and said waste toner chamber are of substantially the same length in the longitudinal direction.

3. The toner cartridge according to claim 1, wherein said waste toner chamber comprises:

(i) an opening formed at a first one of opposed longitudinal ends of said waste toner chamber, said waste toner chamber receiving waste toner through said opening from an external device; and (ii) a toner conveying member extending between the first one of the opposed longitudinal ends and a second one of the opposed longitudinal ends, said toner conveying member causing the waste toner to move away from said opening.

4. The toner cartridge according to claim 3, wherein said toner conveying member includes a shaft having a spiral blade formed thereon.

5. The toner cartridge according to claim 4, wherein said spiral blade is formed substantially across said shaft.

6. The toner cartridge according to claim 1, wherein said waste toner chamber has opposed longitudinal ends and includes a toner conveying member provided therein;

wherein said toner conveying member extends substantially horizontally between a first one of the opposed longitudinal ends and a second one of the opposed longitudinal ends and causes the waste toner to move toward the second one of the opposed longitudinal ends;

wherein said toner conveying member includes a shaft having a spiral blade formed on a part of a length of said shaft.

7. The toner cartridge according to claim 1, wherein said fresh toner chamber comprises (i) an opening through which toner is discharged from said fresh toner chamber, (ii) a shutter, (iii) an operating lever, and (iv) a locking mechanism, wherein the shutter closes the opening when the operating lever is at a first position at which the operating lever is locked by the locking mechanism, and opens the opening when the operating lever is at a second position opposite to the first position.

8. A toner cartridge extending generally in a longitudinal direction, the toner cartridge removably being attached to a print process cartridge that has a waste toner exit, the toner cartridge comprising:

a housing;

a fresh toner chamber provided in said housing;

a waste toner chamber provided in said housing, said waste toner chamber being at least partly adjacent to said fresh toner chamber, said waste toner chamber having an entrance through which waste toner is received; and a partition disposed in said housing, said partition extending in the longitudinal direction to divide an inner space of said housing to define said fresh toner chamber and said waste toner chamber such that said fresh toner chamber and said waste toner chamber extend parallel to each other and are at least partly horizontally adjacent when the toner cartridge has been attached to the print process cartridge, wherein when the waste toner exit enters the entrance, the entrance yieldably resiliently opens to direct the waste toner from the waste toner exit of the print process cartridge into said waste toner chamber, and when the waste toner exit of the print process cartridge moves out of said entrance, said entrance closes resiliently.

9. The toner cartridge according to claim 8, wherein said entrance comprises a resilient member fitted thereinto, said resilient member having a slit formed therein, wherein when the waste toner exit enters the waste toner chamber through said entrance, the slit yieldably opens so that the waste toner exit passes through the slit.

10. The toner cartridge according to claim 9, wherein said resilient member is folded at said slit when said resilient member is fitted into said entrance.

11. The toner cartridge according to claim 9, wherein said resilient member is a sleeve having a first end secured to said entrance and a second end normally resiliently closed, wherein the second end of the sleeve yieldably opens when the waste toner exit enters into the waste toner chamber through said entrance, and the second end of the sleeve resiliently closes when the waste toner exit moves out of the waste toner chamber through said entrance.

12. The toner cartridge according to claim 9, wherein said resilient member is urged by a spring against said entrance, wherein said resilient member is yieldably pushed away from said entrance to open said entrance when the waste toner exit enters the waste toner chamber through said entrance, and is urged toward said entrance to close said entrance when the waste toner exit moves out of the waste toner chamber through said entrance.

13. A toner cartridge and a print process cartridge that receives only a corresponding toner cartridge, wherein the toner cartridge has a first fitting portion indicative of a particular type of content and the print process cartridge has a second fitting portion, wherein the toner cartridge is received into the print process cartridge only when the first fitting portion fits to the second fitting portion in mating engagement.

14. The toner cartridge according to claim 3, wherein said toner conveying member is at an angle with a longitudinal direction of the toner cartridge such that said toner conveyor becomes higher with increasing distance from the first one of the opposed longitudinal ends.

15. The toner cartridge according to claim 1, wherein said fresh toner chamber has a first fixed volume and said waste toner chamber has a second fixed volume.

16. The toner cartridge according to claim 1, wherein said fresh toner chamber has an opening formed in a bottom wall thereof through which fresh toner is discharged from said fresh toner chamber, and said waste toner chamber has an opening formed in a side wall thereof through which waste toner is introduced into said waste toner chamber.

17. The toner cartridge according to claim 1, wherein said fresh toner chamber includes a member that agitates fresh toner held in said fresh toner chamber and said waste toner chamber includes a toner-conveying member that causes waste toner to move from a near end of the chamber toward a far end of said waste toner chamber.

18. The toner cartridge according to claim 1, further comprising a first fitting portion at a bottom of the toner cartridge, wherein the toner cartridge can be properly attached to a print process cartridge only when the first fitting portion fits to a corresponding portion of the print process cartridge.

19. The toner cartridge according to claim 8, wherein said fresh toner chamber has a first fixed volume and said waste toner chamber has a second fixed volume.

20. The toner cartridge according to claim 8, wherein said fresh toner chamber has an opening formed in a bottom wall thereof through which fresh toner is discharged from said fresh toner chamber, and said waste toner chamber has an opening formed in a side wall thereof through which waste toner is introduced into said waste toner chamber.

21. The toner cartridge according to claim 8, wherein said fresh toner chamber includes a member that agitates fresh toner held in said fresh toner chamber and said waste toner chamber includes a toner-conveying member that causes waste toner to move from a near end of the chamber toward a far end of said waste toner chamber.

22. The toner cartridge according to claim 8, further comprising a first fitting portion at a bottom of the toner cartridge, wherein the toner cartridge can be properly attached to a print process cartridge only when the first fitting portion fits to a corresponding portion of the print process cartridge.

23. The toner cartridge and the print process cartridge according to claim 13, wherein the first fitting portion includes at least one recess and the second fitting portion includes at least one projection, wherein the projection fits into the recess when the toner cartridge is attached to the print process cartridge.

24. The toner cartridge and the print process cartridge according to claim 23, wherein the second fitting portion includes a piece having a plurality of holes formed therein and the at least one projection partly fitted into one of the plurality of holes.

25. The toner cartridge and the print process cartridge according to claim 13, wherein the first fitting portion includes two pieces each of which has a same shape and has a first engagement portion formed therein.

26. The toner cartridge and the print process cartridge according to claim 25, wherein the first engagement portion is formed at one of a plurality of different locations on each of the two pieces such that a non-corresponding toner cartridge is prevented from being inserted into the print process cartridge.

27. The toner cartridge and the print process cartridge according to claim 13, wherein the first fitting portion is indicative of a particular color of toner.

28. A toner cartridge that can be attached to a print process cartridge, wherein the toner cartridge has a first fitting portion indicative of a particular type of content and provided at a bottom thereof, wherein only when the toner cartridge is inserted into a corresponding print process cartridge, the first fitting portion fits into the print process cartridge in mating engagement with the print process cartridge.

29. The toner cartridge according to claim 28, wherein the first fitting portion includes two pieces each of which has a same shape and has a first engagement formed therein.

30. The toner cartridge according to claim 29, wherein the first engagement portion is formed at one of a plurality of different locations on each of the two pieces such that a non-corresponding toner cartridge is prevented from being inserted into the print process cartridge.

31. The toner cartridge and the print process cartridge according to claim 28, wherein the first fitting portion is indicative of a particular color of toner.

* * * * *